US009227774B2

(12) United States Patent
Nanba et al.

(10) Patent No.: US 9,227,774 B2
(45) Date of Patent: Jan. 5, 2016

(54) ZIPPER AND ZIPPER-EQUIPPED BAG

(75) Inventors: Yoshinori Nanba, Sodegaura (JP); Kenichi Tanaka, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 644 days.

(21) Appl. No.: 11/720,997

(22) PCT Filed: Dec. 7, 2005

(86) PCT No.: PCT/JP2005/022477

§ 371 (c)(1),
(2), (4) Date: Jun. 6, 2007

(87) PCT Pub. No.: WO2006/062136

PCT Pub. Date: Jun. 15, 2006

(65) Prior Publication Data

US 2009/0238500 A1 Sep. 24, 2009

(30) Foreign Application Priority Data

Dec. 7, 2004 (JP) ..... 2004-354560
Dec. 28, 2004 (JP) ..... 2004-379276

(51) Int. Cl.

| | |
|---|---|
| ***B65D 33/16*** | (2006.01) |
| ***A44B 1/04*** | (2006.01) |
| ***B65D 75/66*** | (2006.01) |
| ***B65D 33/25*** | (2006.01) |

(52) U.S. Cl.
CPC ..... *B65D 75/66* (2013.01); *B65D 33/2533* (2013.01); *Y10T 24/2532* (2015.01)

(58) Field of Classification Search
CPC ..... B65D 33/2533; B65D 33/2525; B65D 33/2508; B65D 33/2591; A44B 19/16
USPC ..... 383/203–206, 61.2, 63, 66, 210–211; 24/399, 400, DIG. 39, DIG. 40, 585.12
See application file for complete search history.

(56) References Cited

U.S. PATENT DOCUMENTS

| | | | | |
|---|---|---|---|---|
| 4,915,289 | A * | 4/1990 | Hatano et al. | 229/123.1 |
| 5,036,643 | A | 8/1991 | Bodolay | |
| 5,121,997 | A * | 6/1992 | La Pierre et al. | 383/203 |
| 5,157,811 | A * | 10/1992 | Bodolay | 24/30.5 R |
| 5,215,380 | A * | 6/1993 | Custer et al. | 383/203 |
| 5,375,930 | A | 12/1994 | Tani | |

(Continued)

FOREIGN PATENT DOCUMENTS

| | | |
|---|---|---|
| CN | 1079439 A | 12/1993 |
| CN | 1461277 A | 12/2003 |

(Continued)

OTHER PUBLICATIONS

Machine translation of Japanese Document No. 2004-276925. Translated on Apr. 23, 2013.*

(Continued)

*Primary Examiner* — Jes F Pascua
(74) *Attorney, Agent, or Firm* — Millen, White, Zelano & Branigan, P.C.

(57) ABSTRACT

A tearing guide strip 23 is integrated with a base part 21*a* or 21*b* of at least one of a male member 2*a* and a female member 2*b* constituting a zipper 2 in a peelable manner to improve the tearing unsealing ability of a zipper-equipped bag provided with an interlocking type zipper enabling resealing and unsealing after the bag is unsealed.

30 Claims, 16 Drawing Sheets

(56) References Cited

U.S. PATENT DOCUMENTS

| | | | | | |
|---|---|---|---|---|---|
| 5,461,845 | A | | 10/1995 | Yeager | |
| 5,486,051 | A | * | 1/1996 | May | 383/200 |
| 5,489,252 | A | | 2/1996 | May | |
| 5,513,915 | A | | 5/1996 | May | |
| 5,660,479 | A | * | 8/1997 | May et al. | 383/204 |
| 5,672,009 | A | * | 9/1997 | Malin | 383/204 |
| 5,954,433 | A | | 9/1999 | Yeager | |
| 7,470,063 | B2 | * | 12/2008 | Leighton | 383/210.1 |
| 7,476,030 | B1 | | 1/2009 | Kuge et al. | |
| 7,597,480 | B2 | | 10/2009 | Kuge et al. | |
| 7,887,653 | B2 | * | 2/2011 | Goto et al. | 156/66 |
| 8,066,434 | B2 | * | 11/2011 | Nanba et al. | 383/204 |
| 2005/0063624 | A1 | | 3/2005 | Goto et al. | |
| 2009/0190867 | A1 | * | 7/2009 | Goto et al. | 383/211 |
| 2009/0238500 | A1 | | 9/2009 | Nanba et al. | |

FOREIGN PATENT DOCUMENTS

| | | | | | |
|---|---|---|---|---|---|
| EP | 528721 | A2 | * | 2/1993 | A44B 19/16 |
| FR | 2586650 | A1 | * | 3/1987 | A44B 19/16 |
| JP | 03-056248 | | | 3/1991 | |
| JP | 06 092362 | | | 4/1994 | |
| JP | 6286758 | A | | 10/1994 | |
| JP | 08268442 | A | * | 10/1996 | B65D 33/00 |
| JP | 2000 255596 | | | 9/2000 | |
| JP | 2000 355336 | | | 12/2000 | |
| JP | 2002104440 | A | * | 4/2002 | B65D 33/00 |
| JP | 2004 244027 | | | 9/2004 | |
| JP | 2004276925 | A | * | 10/2004 | B65D 33/00 |
| JP | 2006-123949 | | | 5/2006 | |
| WO | 9317931 | A1 | | 9/1993 | |
| WO | WO 02/22452 | A1 | | 3/2002 | |
| WO | 03051729 | A1 | | 6/2003 | |

OTHER PUBLICATIONS

First Office Action of Chinese Patent Application No. 200580042112.2 (Apr. 10, 2009).

HOSOKAWA YOKO CO Ltd., "Zipper Bag," Patent Abstracts of Japan, Publication Date: Dec. 26, 2000; English Abstract of JP2000 355336.

CI SANPLUS KK., "Easiliy-cuttable fitting tool, and bag body with the same," Patent Abstracts of Japan, Publication Date: Sep. 2, 2004; English Abstract of JP2004 244027.

KRAFT GENERAL FOODS, Inc., "Reclosable pouch and its forming, filling and sealing method," Patent Abstracts of Japan, Publication Date: Apr. 5, 1994; English Abstract of JP 06 092362.

Shiyou, Obara, "Fastener bag and its manufacture," Patent Abstracts of Japan, Publication Date: Mar. 11, 1991; English Abstract of JP 03 056248.

HOKOKAWA YOKO CO Ltd., "Zipper Bag and Zipper Device," Patent Abstracts of Japan, Publication Date: Sep. 19, 2000; English Abstract of JP 2000 255596.

Japanese Office Action relating to JP-A-2006-123949 (D1).

Supplementary European Search Report for EP05814562, Date of completion of the search: Dec. 12, 2012.

Search Report dated Sep. 22, 2014 issued in corresponding Chinese Patent Application ZL200580042112.2 (pp. 1-9).

Verified English Translation of Japanese Publication No. 2003-067600, published Oct. 7, 2004, titled "Engagement Element and Packaging Bag".

English Translation of WO 93/17931, Publishing Date: Sep. 16, 1993.

English language Abstract of JPH06286758; Publishing Date: Oct. 11, 1994.

Chemical Industry Press, "Chemistry and Chemical Dictionary"; dictionary; published Jan. 2003, 1st Edition, pp. 1243-1244.

Xu Lixin, "PP Nanocomposite Structure, Performance And Technology Research", Zhejiang University of Monks Papers; Masters's Thesis, published May 2002 p. 3.

English language translation of Chemical Industry Press, "Chemistry and Chemical Dictionary"; dictionary; published Jan. 2003, 1st Edition, pp. 1243-1244.

English languages translation of Xu Lixin, "PP Nanocomposite Structure, Performance And Technology Research", Zhejiang University of Monks Papers; Master's Thesis, published May 2002 p. 3.

* cited by examiner

ZIPPER AND ZIPPER-EQUIPPED BAG

TECHNICAL FIELD

The present invention relates to a zipper which can be improved in unsealing ability and a zipper-equipped bag provided with such a zipper, in a zipper-equipped bag provided with an interlocking-type zipper so as to enable the bag to be resealed and unsealed after the bag is unsealed.

BACKGROUND ART

Zipper-equipped bag which are provided with an interlocking-type zipper (interlocking fitting tool) at their mouth parts where the content is taken in and out and can be resealed and unsealed after the bag is unsealed have been used in many fields such as foods, chemicals and miscellaneous goods (for example, Patent Documents 1, 2 and 3).

These zipper-equipped bags are usually produced in the following manner: a zipper formed into a tape form is prepared in advance and a base film as a bag raw material is sealed with the zipper to make a bag.

Patent Document 1: Japanese Patent Application Laid-Open No. 2004-244027

Patent Document 2: Japanese Patent Application Laid-Open No. 2000-355336

Patent Document 3: Japanese Patent Application Laid-Open No. 2004-276925

DISCLOSURE OF THE INVENTION

Problem to be Solved by the Invention

In the meantime, this type of zipper-equipped bag is generally so constituted that it can be unsealed by tearing a bag raw material at the unsealing part by the hand without using scissors or the like. However, if the bag raw material is not well torn, it causes inconvenience in use after the bag is unsealed.

For example, if the bag raw material is cut so excessively when the bag is unsealed that the part to be held by the hand when the bag is unsealed by releasing the interlocking of the zipper or the sizes of this part are uneven, the bag is put in the state where it is unsealed with difficulty. Also, if even the zipper is cut by mistake when the bag raw material is torn, resealing with the zipper cannot be attained.

For this, various proposals have been offered to be able to tear the fixed position of the bag raw material.

For example, in Patent Document 1, a bag is reported in which an easily cuttable resin layer having a specific composition is disposed at the tape part of a zipper (bandy fitting tool) and the bag is unsealed along this easily cuttable resin layer.

However, in the bag proposed in Patent Document 1, the easily cuttable resin layer is formed of a composition including a mixture of two types of resin such that the direction in which the bag is unsealed is fixed by breaking the easily cuttable resin layer when the bag is unsealed. There is therefore the problem that fibrous cutting scum is generated on the broken surface, with the result that the content is contaminated with such cutting scum.

Also, in the case of the zipper of Patent Document 1, it is necessary to prevent the easily cuttable resin layer from being heated by the heat from a heat seat bar when the zipper is bound with a base film used as a bag raw material by sealing such that the easily cuttable resin layer is prevented from adhering to the base film (for example, Patent Document 1, Paragraph No. [0018]). This zipper has the problem that, for example, not only it is necessary to prepare a heat seal bar having a predetermined seal surface but also strict alignment is required when the zipper is bound with the base film by sealing, requiring troublesome time and labor for the binding of the zipper with the base film. This zipper has therefore a large problem which must be improved to produce a zipper-equipped bag in an efficient manner.

Also, in Patent Document 2, a zipper-equipped bag (fastener bag) is proposed which is so devised that a cut tape is fixed to between a male zipper member and a female zipper member provided inside of a baggy container produced by binding the side edges of one lapping material with each other by heat sealing and a part of the baggy container is cut by the cut tape to unseal the container.

Although general automatic packaging machines may be applied to the fastener bag of Patent Document 2, so that this fastener bag makes it possible to avoid the complication of apparatuses and troublesome workings. The packaging means includes, heat-sealing the side edge of the lapping material fitted with the zipper to make a cylinder body, heat-sealing the opening part of one of both ends in the longitudinal direction of the zipper and then filling the content from the opening part of the other end (see Patent Document 2, Paragraph No. [0023]).

For this reason, the shape of the fastener bag described in Patent Document 2 is limited to a flat form and it is difficult to apply this fastener bag to a standing bag which can be formed to be self-stood and has come to be frequently used in recent years. Also, because the zipper and the cut tape are constituted as separate bodies, the zipper and the cut tape must be installed separately (see Paragraph No. [0020]). This is the reason why a further improvement in production efficiency is desired.

Also, Patent Document 3 proposes a zipper-equipped bag (packaging bag) which is so constituted that an unsealing string is fitted to the band base part of the zipper (interlocking tool) in an embedded state along the longitudinal direction and the bag can be unsealed with a fixed orientation by pulling the unsealing string.

The zipper of Patent Document 3 is free from a problem such as those mentioned above which are involved in Patent Document 1 and also, it is unnecessary to fit the zipper and the unsealing string separately to the base film by sealing. This zipper-equipped bag is very superior also in production efficiency.

However, when the bag is unsealed by pulling the unsealing string, it is necessary to tear the band base part together with the base film and therefore, power is required to unseal and it is therefore pointed out that the bag is unsealed with difficulty by a powerless person.

In the conventional art technologies as mentioned above, each bag can be unsealed by tearing a fixed position of a bag raw material using a cut tape or an unsealing string and therefore, it is not inconvenient in use after unsealed. However, there is a room for improvement to comply with an increased demand for better performance in the market.

The present invention has been proposed to solve the problems involved in the foregoing conventional art technologies. It is an object of the present invention to provide a zipper which can be improved in the tearing-unsealing ability of a zipper-equipped bag and also to provide a zipper-equipped bag.

Means for Solving the Problem

A zipper according to the present invention includes paired male member having a male projection and female member having a female projection which are interlocked with each other, the zipper being fitted to a bag and enabling the bag to be resealed and unsealed after the bag is unsealed, wherein a tearing guide strip is integrated with at least one of the base parts of the male member and female member and the tearing guide strip can be separated from the base part of the male member or female member.

A bag equipped with the zipper having such a structure according to the present invention can be easily unsealed by pulling the tearing strip to tear a bag raw material and also, the force required for unsealing can be reduced to the utmost by adjusting the binding condition of the tearing guide strip to the base part of male member or female member properly. It is therefore possible to improve the unsealing ability with ease.

Also, the zipper according to the present invention may have a structure in which in the state where it is fitted to the bag, a tearing guide strip is integrated with the end part in the width direction of the base part of the male member and/or base part of the female member positioned on the unsealing side of the bag, and the above tearing guide strip can be peeled from the above end part at the binding interface between the both.

Such a structure reduces a resistant feel when the bag raw material on the unsealing side against the zipper is torn to unseal the bag and also, it is possible to guide the direction of tearing with a fixed orientation such that the bag raw material is torn linearly along the longitudinal direction of the zipper since the tearing guide strip is integrated with the zipper such that it can be peeled from the zipper by interfacial peeling at the binding interface. For this, the bag is easily unsealed, the unsealing mouth to be formed after the bag is unsealed is formed in a well shape-reproducible manner and the bag obtained after unsealed is not resultantly inconvenient in use. Moreover, since the tearing guide strip is separated as a result of the interfacial peeling at the binding interface at which the tearing guide strip is bound with the zipper, no cutting scum is generated at the peeled surface.

Also, the zipper according to the present invention may have a structure in which the base part of the male member and/or the base part of the female member provided with the tearing guide strip is provided with a thickened part along the longitudinal direction in the part thereof in the vicinity of the tearing guide strip.

Even if the direction in which the bag raw material is torn is directed to the zipper side, such phenomenon is prevented that the zipper is torn to the vicinity of the interlocking part so that the part to be held by the hand when the interlocking of the zipper is released to reseal the bag is lost. Also, the direction in which the bag raw material is torn can be corrected to the normal direction.

The zipper according to the present invention may have a structure in which in the state where the male member is interlocked with the female member, the base part of one of the male member and the female member is extended projecting toward the unsealing side of the bag such that the length of its width is larger than that of the base part of the other of the male member and the female member, the tearing guide strip is integrated with the surface side on which the male projection or female projection is formed in the extended part of the base part of one of the male member and female member and the tearing guide strip is peelable from the base part of one of the male member and the female member.

Because in such a structure, the tearing guide strip is integrated with one of the male member and female member in such a manner as to be separable by peeling from the zipper, this reduces a resistant feel when the bag raw material on the unsealing side against the zipper is torn to unseal the bag. Also, because the part where the tearing guide strip is provided is projected more closely to the unsealing side than that of the other of the male member or female member, the direction of tearing can be guided with a fixed orientation such that the bag raw material is torn linearly along the longitudinal direction of the zipper without being disturbed by the other of the male member or female member.

For this reason, the bag is easily unsealed and the unsealing mouth formed after unsealed is formed in a well shape-reproducible manner and the bag obtained after unsealed is not resultantly inconvenient in use.

Also, the zipper according to the present invention may have a structure in which the tearing guide strip may be provided with a heat seal layer made of a resin that can be bound with the raw material forming the bag by heat sealing on the surface facing the raw material forming the bag by binding strength higher than the peeling strength between the tearing guide strip and the base part of one of the base part of the male member and the female member on which the tearing guide strip is to be formed when the zipper is fitted to the bag.

This makes it possible to effectively avoid the phenomenon that peeling is caused between the tearing guide strip and the bag raw material in unsealing and to allow the peeling of the tearing guide strip from the zipper to prevail.

Also, according to the present invention, the zipper is configured such that the peeling strength between the zipper and the tearing guide strip is preferably 15 N/15 mm or less.

This reduces the force required to peel the tearing guide strip from the zipper and therefore, a good unsealing feel is obtained because the force tearing the bag raw material is substantially the force required to unseal the bag.

Also, the tearing guide strip preferably has a higher rigidity than the base part of the male member and/or base part of the female member on which the tearing guide strip is to be provided. More specifically, the tensile elastic modulus of the tearing guide strip is preferably 1.3 to 4 times that of the base part.

This makes it possible to prevent the tearing guide strip from being broken by material destruction, bringing about good peeling and making it possible to avoid any trouble to the tearing of the bag raw material.

Also, a zipper-equipped bag according to the present invention includes a zipper fitted thereto and provided with paired male member having a male projection and female member having a female projection which are interlocked with each other and enabling the bag to be resealed and unsealed after the bag is unsealed, wherein a tearing guide strip is integrated with the base part of the male member and/or the base part of the female member which are provided in the zipper at the end part in the width direction positioned on the unsealing side of the bag in such a manner that it can be separated from the base part at the binding interface between the end part and the tearing guide strip.

Such a structure reduces a resistant feel when the bag is unsealed and also, the tearing guide strip linearly guides the direction of tearing with a fixed orientation such that the bag raw material is torn linearly along the longitudinal direction of the zipper. Therefore, the bag is easily unsealed and the unsealing mouth formed after unsealed is formed in a well shape-reproducible manner and the bag obtained after unsealed is not resultantly inconvenient in use.

Also, another zipper-equipped bag according to the present invention includes a zipper fitted thereto and provided with paired male member having a male projection and female member having a female projection which are interlocked with each other and enabling the bag to be resealed and unsealed after the bag is unsealed, wherein the base part of one of the male member or the female member is extended such that the length in the width direction is longer toward the unsealing side than that of the other of the base parts of the male member and female member, the tearing guide strip is integrated with the surface on which the male projection or the female projection is formed in the extended part of the base part of one of the male member and the female member in a freely peelable manner and also, the tearing guide strip is bound with the same surface on which the other of the male member or the female member is bound with the raw material forming the bag.

Such a structure reduces a resistant feel when the bag is unsealed and also, the tearing guide strip linearly guides the direction of tearing with a fixed orientation such that the bag raw material is torn linearly along the longitudinal direction of the zipper. Therefore, the bag is easily unsealed and the unsealing mouth formed after unsealed is formed in a well shape-reproducible manner and the bag obtained after unsealed is not resultantly inconvenient in use.

Also, another zipper-equipped bag according to the present invention may have a structure in which the surface on the side on which the male projection or the female projection is formed along the end edge of the extended part of the base part of one of the male member and the female member is bound with the same surface with which the male member or the female member of the raw material forming the bag is bound to fit the zipper.

This eliminates the necessity of releasing the interlocking of the zipper when the content is filled, thereby making it possible to avoid the adhesion of the content to the interlocking part of the zipper.

Effect of the Invention

The present invention ensures that the tearing guide strip is integrated with at least one of the male member and the female member such that it is separated by peeling, whereby the bag equipped with the zipper can be easily unsealed by only pulling the tearing guide strip to tear the bag raw material. Also, the force required for unsealing can be reduced to the utmost by adjusting the binding condition of the tearing guide strip to the base part of the male member or female member properly. It is therefore possible to improve the unsealing ability with ease.

DESCRIPTION OF THE REFERENCE NUMERALS

Figure 1:
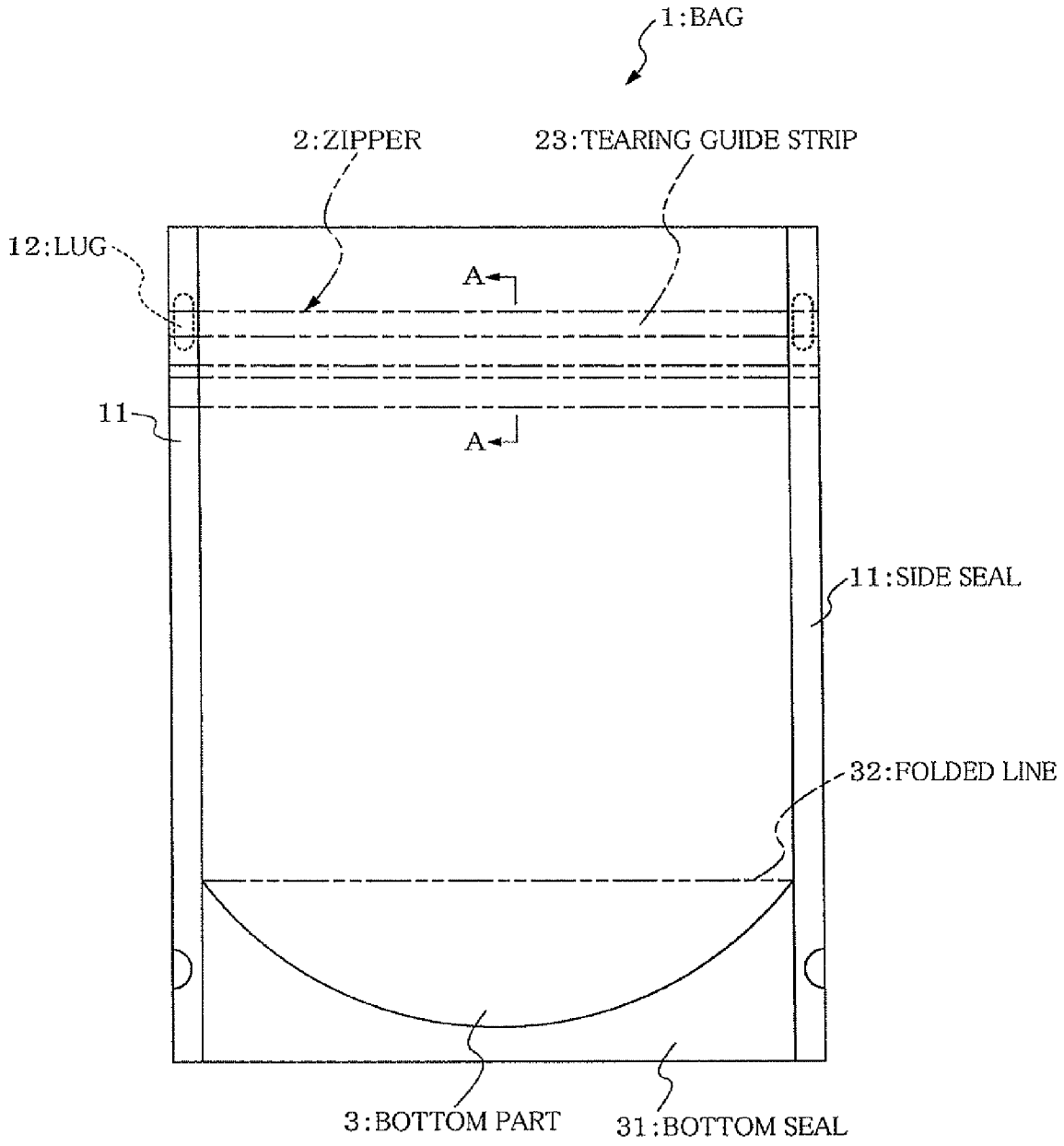
FIG. 1 is a plan view showing the outline of a zipper-equipped bag of a first embodiment according to the present invention.

1 Bag
10*a*, 10*b* Base film
14 Unsealing mouth
2 Zipper
2*a* Male member
21*a* Base part
2*b* Female member
21*b* Base part
211 Extended part
23 Tearing guide strip
231 Base material
232 Heat seal layer
233 Gap
24 convex streak (thickened part)

BEST MODE FOR CARRYING OUT THE INVENTION

Preferred embodiments according to the present invention will be explained with reference to the drawings.

[First Embodiment]

First, a zipper-equipped bag of a first embodiment according to the present invention will be explained.

FIG. 1 is a front view showing the outline of the first embodiment of the zipper-equipped bag according to the present invention.

A bag 1 shown in FIG. 1 is produced by making a bag using base films 10*a* and 10*b* used as a bag base material heat-sealed with a zipper 2 and is a so-called standing bag which is produced by providing a side seal 11 along the side edge in the state the bottom part 3 provided with a bottom seal 31 is folded along a fold line 32.

Also, in the example illustrated, the upper edge of the bag 1 is unseated part. After the content is filled, a top seal 13 is provided.

Figure 2:
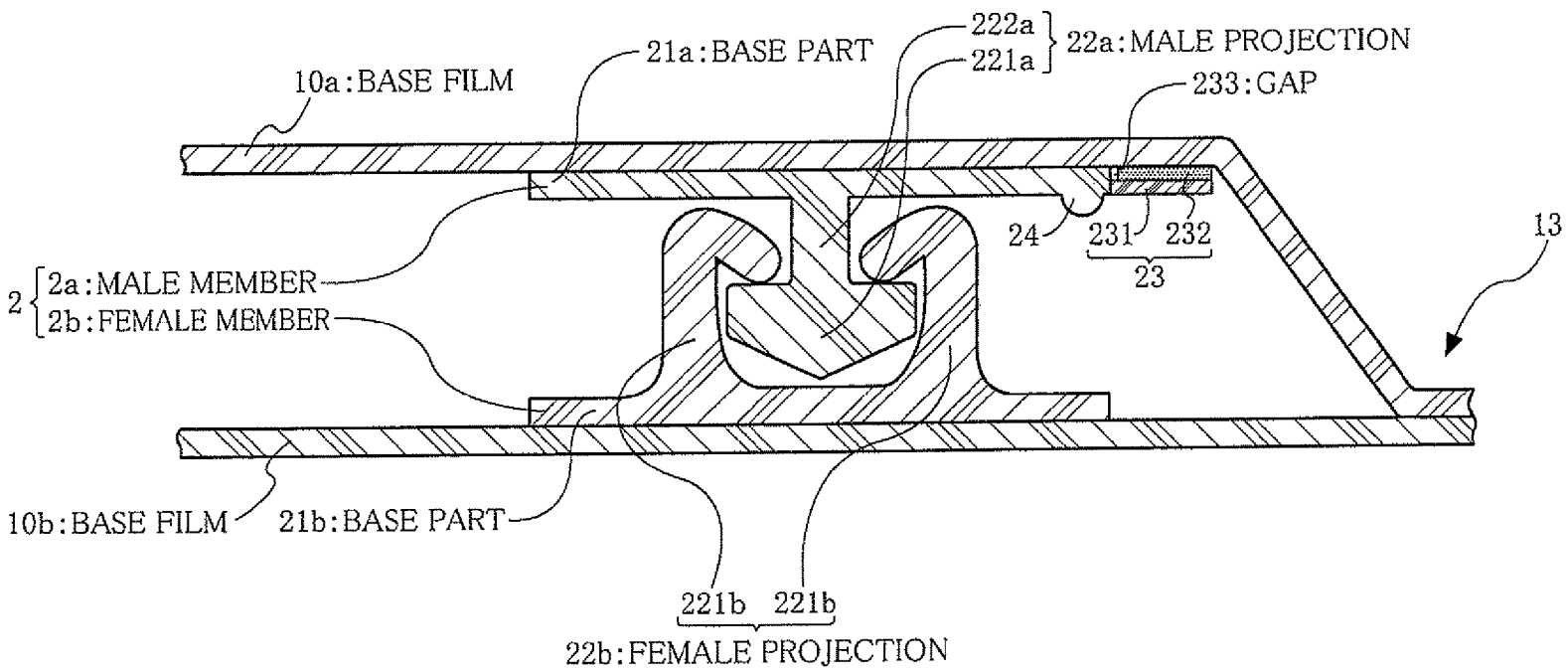
FIG. 2 is a sectional view showing a part corresponding to the section A-A of FIG. 1 in the condition of a zipper-equipped bag after a top seal is provided to a zipper-equipped bag of a first embodiment according to the present invention.

FIG. 2 is a sectional view showing a part corresponding to the section A-A of FIG. 1 in the state after the top seal 13 is provided. The top seal 13 is provided so as to form a predetermined space between the top seal 13 itself and the zipper 2 fitted to the upper part of the bag 1.

The zipper 2 in this embodiment is constituted of paired male member 2*a* and female member 2*b* as shown in FIG. 2.

The male member 2*a* is provided with a base part 21*a* formed continuously like a tape. A male projection 22*a* constituted of a head part 221*a* and a connecting part 222*a* connecting the head part 221*a* with the base part 21*a* is provided on one surface of the base part 21*a* and these parts are formed to be integrated continuously. Then, the other surface of the base part 21*a* is bound with the base film 10*a* by heat sealing. Similarly, the female member 2*b* is provided with a base part 21*b* formed continuously like a tape. A female projection 22*b* constituted of a pair of hook parts 221*b* and 221*b* is provided on one surface of the base part 21*b* and these parts are formed to be integrated continuously, Then, the other surface of the base part 21*b* is bound with the base film 10*b* by heat sealing.

In the zipper 2 constituted in this manner, the head part 221*a* of the male projection 22*a* is fitted in a space formed between the hook parts 221*b* and 221*b* of the female projection 22*b*, whereby the male projection 22*a* and the female projection 22*b* are interlocked with each other. Thereby the takeout port of the bag 1 can be sealed (resealing) after the bag is unsealed by the zipper 2. When the interlocking of the zipper 2 (interlocking between the male projection 22*a* and the female projection 22*b*) is released, the takeout port of the bag 1 can be unsealed.

The specific shapes of the male projection 22*a* and female projection 22*b* are not limited to those shown in the figure as long as these projections have fitting shapes which are paired and interlocked with each other.

The male member 2*a* and the female member 2*b* may be formed, for example, by extrusion molding of a thermoplastic resin and the like. As the thermoplastic resin such as, for example, a polyolefin type resin such as polypropylene, low-density polyethylene (LDPE) and linear low-density polyethylene (LLDPE), and an ethylene/methacrylic acid copolymer may be used. The male member 2*a* and the female member 2*b* may have a multilayer structure using plural resins in consideration of the interlocking ability between the male member 2*a* and the female member 2*b*, the sealing strength and heat sealing characteristics of the male member 2*a* and the female member 2*b* with the base films 10*a* and 10*b*.

Also, the same thermoplastic resin made into a film form may be used for the base films 10*a* and 10*b* in consideration of the sealing strength and heat sealing characteristics with the zipper 2 (male member 2*a* and female member 2*b*). The base films 10*a* and 10*b* may have a multilayer structure to allow these films to exhibit various functions as the bag. In this case, for example, the inside layer to be the inside surface of the bag 1 is formed of the same thermoplastic resin as above as the heat seal layer for the zipper 2. Also, biaxially oriented nylon, biaxially oriented polyethylene terephthalate or biaxially oriented polypropylene may be laminated together with the heat seal layer as the outside surface of the bag 1, and a barrier layer made of an aluminum foil or an ethylene/vinyl alcohol copolymer film may be laminated as an intermediate layer.

In this embodiment, as shown in FIG. 2, the zipper 2 is provided with a tearing guide strip 23 integrated therewith along the longitudinal direction at the end part positioned on the side provided with the top seal 13 of the bag 1 in the state where the male member 2*a* is bound with the base film 10*a* by heat sealing among both ends in the width direction of the base part 21*a* of the male member 2*a*. In the example illustrated, the tearing guide strip 23 is disposed in such a manner as to be integrated with the male member 2*a*, directly, by binding the base material 231 with the base part 21*a* of the male member 2*a* so as to be peelable at the binding interface between the both.

At this time, the peeling strength between the tearing guide strip 23 and the male member 2*a* is designed to be preferably 15 N/15 mm or less. When the peeling strength exceeds this value, there is a fear that cohesive peeling is caused to generate cutting scum. Also, the force required to separate the tearing guide strip 23 from the male member 2*a* by peeling is increased and it is therefore difficult to obtain a good unsealing feel. Moreover, such a disorder arises that when the bag 1 is unsealed, the tearing guide strip 23 is not separated from the male member 2*a* but the direction of tearing is toward to the male member 2*a*, causing a fear that the base part 21*a* of the male member 2*a* is eventually torn.

Here, the peeling strength between the tearing guide strip 23 and the male member 2*a* means the largest load found when the both put in a bound state are cut into a test piece having a width of 15 mm and the test piece is subjected to a tensile tester carried out at a measuring atmospheric temperature of 23° C. at a tensile rate of 200 mm/min to peel the both from each other along the direction perpendicular to the direction of the width of the test piece.

A heat seal layer 232 made of a resin which can be bound with the base film 10*a* by heat sealing is disposed on the surface of the base material 231 facing the base film 10*a* of the base material 231 and the tearing guide strip 23 is designed to bind with the part where the base film 10*a* is torn when the bag 1 is unsealed as will be explained later.

At this time, the binding strength between the base film 10*a* and the tearing guide strip 23 is preferably made to be larger than the peeling strength between the tearing guide strip 23 and the male member 2*a*. It is thereby possible to efficiently avoid the peeling of the tearing guide strip 23 from the base film 10*a* in unsealing and to allow the peeling of the tearing guide strip 23 from the male member 2*a* to prevail.

The zipper 2 in this embodiment which is provided with the tearing guide strip 23 like this may be fitted to the bag 1 by heat sealing in the same manner as in the case of conventionally known zippers without using a specific heat seal bar.

In the example illustrated, the heat seal layer 232 is disposed such that a gap 233 is formed at a position apart from the end part of the base part 21*a* of the male member 2*a* so as not to hinder the peeling of the tearing guide strip 23 from the male member 2*a*. Also, if the base material 231 is bound with the male member 2*a* in a freely peelable manner and can be bound with the base film 10*a* by a higher binding strength than the peeling strength required separating the male member 2*a*, by heat sealing, the heat seal layer 232 may be eliminated as desired.

In this embodiment, the tearing guide strip 23 may be integrated with the male member 2*a* simultaneously when the male member 2*a* is molded, for example, by extrusion-supplying the material forming the tearing guide strip 23 to one of the end parts in the width direction so as to carry out co-extrusion.

As the resin forming the base material 231, a resin incompatible with the resin used for the male member 2*a* may be selected. For example, in the case of using polyethylene for the male member 2*a*, polypropylene may be used for the base material 231. On the other hand, polypropylene is used for the male member 2*a*, a polyester resin such as polyethylene terephthalate and polybutylene terephthalate may be used. A modifier may be added properly to these resins, to thereby adjust the peeling strength between the both such that the both are peeled at the interface between them.

Also, as the resin forming the heat seal layer 232, one which has sufficient binding strength with the base film 10*a* and the base material 231 and is resistant to peeling from these materials when the bag 1 is unsealed is properly selected. For example, when polyethylene is used for the base film 10*a* (or the heat seal layer for the male member 2*a* of the base film 10*a*) and polypropylene is used for the base material 231, metallocene type linear low-density polyethylene may be used. Also, when polyethylene is used for the base film 10*a* (or the heat seal layer for the male member 2*a* of the base film 10*a*) and polybutylene terephthalate is used for the base material 231, a modified polyolefin type resin such as maleic acid anhydride modified polypropylene may be used.

Also, the tearing guide strip 23 preferably has a higher rigidity than the base part 21*a* of the male member 2*a* to allow itself to be well separated from the male member 2*a* without being disturbed by material destruction when it is separated from the male member 2*a* and not to give hindrance to tearing of the base film 10*a*. More specifically, the tensile elastic modulus of the tearing guide strip 23 is preferably 1.3 to 4 times that of the base part 21*a* of the male member 2*a*. At this time, the tensile elastic modulus of the tearing guide strip 23 is particularly preferably in a range from 300 to 2500 MPa.

When the tensile elastic modulus of the tearing guide strip 23 exceeds the above range, the tearing guide strip 23 is broken when the bag 1 is unsealed, leading to such a disorder that the bag 1 is unsealed with difficulty.

On the other hand, when the tensile elastic modulus of the tearing guide strip 23 is less than the above range, the tearing guide strip 23 has only insufficient rigidity, causing a hindrance to the peeling from the male member 2*a* or the tearing of the base film 10*a*.

Moreover, such a disorder is caused that the tearing guide strip 23 is broken and the bag 1 cannot be unsealed resultantly.

Also, according to such as the material, or the degree of orientation of the base film 10*a*, the base film 10*a* is not torn along the part where it is bound with the tearing guide strip 23 but the direction of tearing is toward to the part where it is bound with the male member 2*a*, and in this case, there is the case where the male member 2*a* is torn together with the base film 10*a*.

In order to avoid such an event, a convex streak 24 is disposed along the longitudinal direction of the male member 2*a* at a part close to the tearing guide strip 23 on the base part 21*a* of the male member 2*a* and the part is thickened than other part in the example illustrated. Thereby, even if the direction of tearing the base film 10*a* is toward to the part where it is bound with the male member 2*a* and a part of the male member 2*a* is torn, it is so devised that this convex streak 24 prevents the male member 2*a* from being further torn and also corrects the tearing direction of the base film 10*a* to the normal direction, that is, the direction along the part bound with the tearing guide strip 23.

Though in the example illustrated, one convex streak 24 is disposed, plural convex streaks 24 may be disposed. There is no particular limitation to the specific shape of the thickened part insofar as it prevents the occurrence of the phenomenon that the zipper 2 (male member 2*a*) is torn, so that the zipper 2 cannot be interlocked by the presence of the thickened part at the part close to the tearing guide strip 23 when the tearing direction of the base film 10*a* is shifted, and the thickened part can correct the tearing direction of the base film 10*a* to the normal direction.

Figure 3:
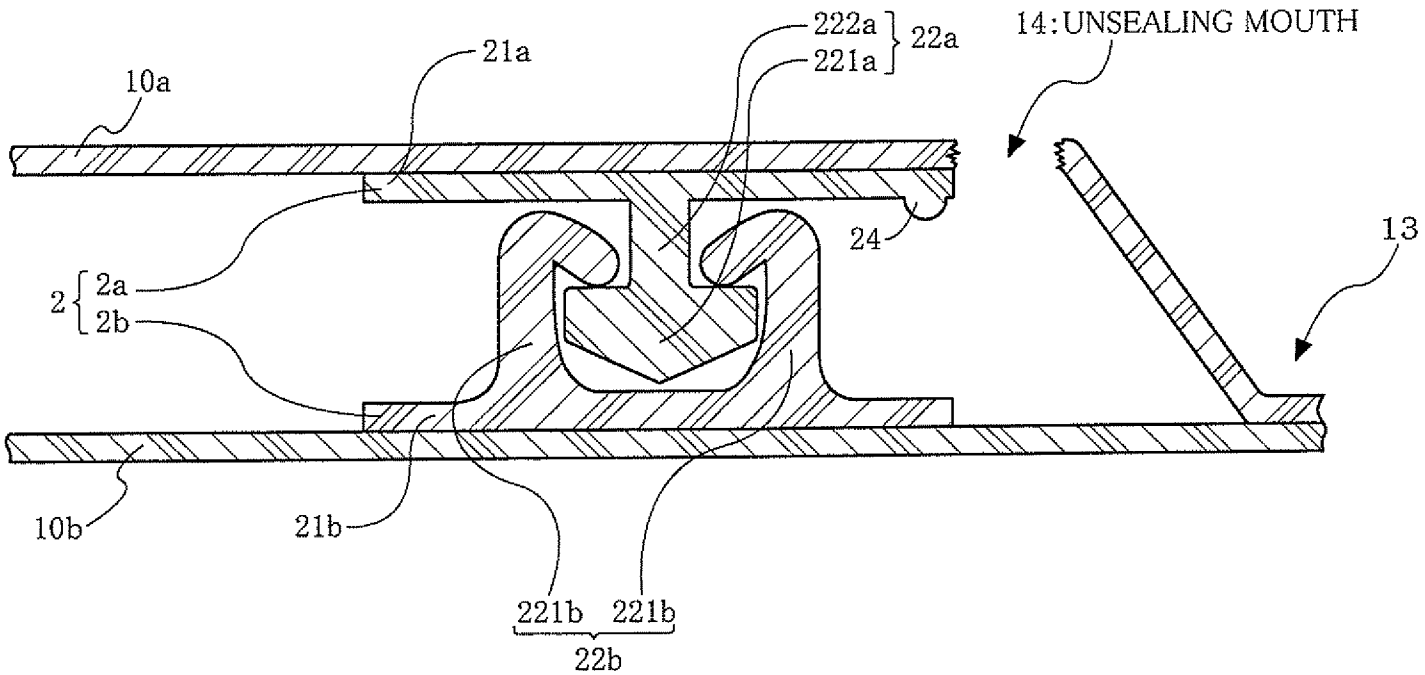
FIG. 3 is a sectional view showing a part corresponding to the section A-A of FIG. 1 after a zipper-equipped bag of a first embodiment according to the present invention is unsealed.

The bag 1 provided with such the zipper 2 is unsealed by pulling the tearing guide strip 23 to thereby tear the part of the base film 10*a* which is bound with the tearing guide strip 23. At the part that has been torn, an unsealing mouth 14 which is to be a port in and from which the content is taken is formed, as shown in FIG. 3. And, it is possible to take in or out the content by releasing the interlocking of the zipper 2. Also, when the zipper 2 is interlocked, the bag 1 can be resealed. After the bag 1 is unsealed, the takeout port can be sealed or unsealed by the zipper 2.

The tearing guide strip 23 (base material 231) is integrated with the male member 2*a* along the end part of the base part 21*a* of the male member 2*a* such that it is separated from the male member 2*a* by interfacial peeling at the binding interface when the bag 1 is unsealed. Therefore, the resistant feel when the bag 1 is unsealed is reduced and also, the tearing guide strip 23 linearly guides the direction of tearing with a fixed orientation such that the base film 10*a* is torn linearly along the longitudinal direction of the zipper 2.

Therefore, the bag 1 is easily unsealed and the unsealing mouth 14 to be formed after the bag 1 is unsealed is formed in a well shape-reproducible manner and the bag 1 obtained after unsealed is not resultantly inconvenient in use. Moreover, the tearing guide strip 23 is separated from the male member 2*a* by interfacial peeling at the binding interface and therefore, no scum is generated on the peeled surface unlike the case shown in the aforementioned Patent Document 1.

Figure 4:
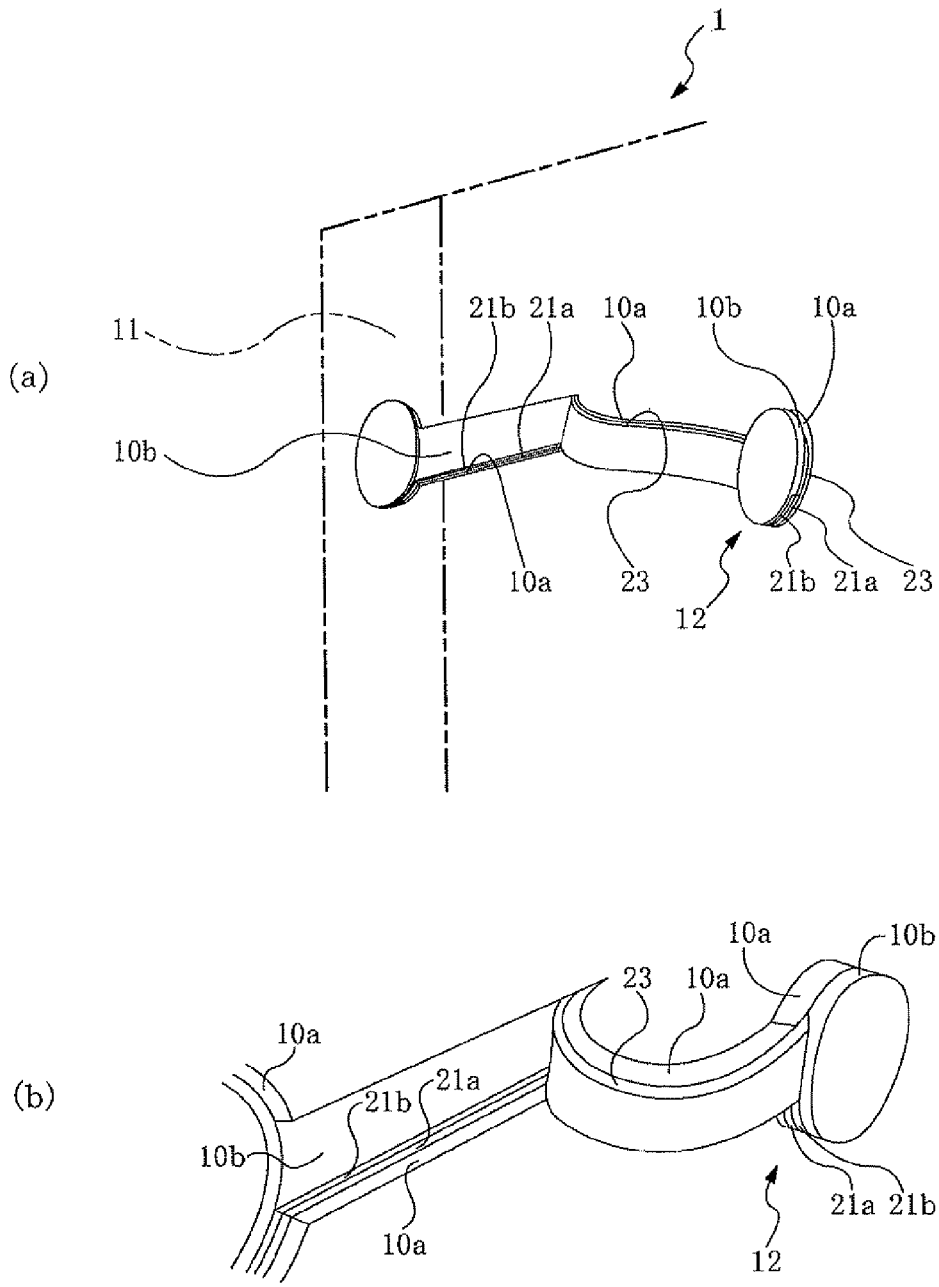
FIG. 4 is an explanatory view showing one example of an unsealing means of a zipper-equipped bag.

Here, an example of a specific means of tearing the base film 10*a* by the tearing guide strip 23 to unseal the bag 1 is shown in FIG. 4.

In the example illustrated, half-cut treatment has been carried out in such a manner as to form a lug 12 penetrating through a part where the side seal 11 on which the tearing guide strip 23 is positioned is formed. It is so devised that at this time, the base film 10*b* constituting a part of the lug 12 is cut off from the other part of the base film 10*b* and the base film 10*a* constituting a part of the lug 12 is cut off from a part other than the part torn when the base film 10*a* is unsealed, to form the lug 12 in the state where the tearing guide strip 23 is sandwiched between the separated base films 10*a* and 10*b*.

When the lug 12 is constituted in this manner, the lug 12 is, as is illustrated, picked up to pull the tearing guide strip 23, whereby the base film 10*a* is torn by the tearing guide strip 23 to form the unsealing mouth 14.

FIG. 4(*a*) is an explanatory view showing the condition that the base film 10*a* is torn by the tearing guide strip 23 and FIG. 4(*b*) is an enlarged view of a major part of the tearing guide strip 23 when it is pulled. Also, in the example illustrated, a part of the base part 21*a* of the male member 2*a* and base part 21*b* of the female member 2*b* is cut off and put into the state sandwiched between the base films 10*a* and 10*b* under the lug 12. The cut parts of the base parts 21*a* and 21*b* have no influence on the resealing function of the lug 12.

According to this embodiment, as mentioned above, the tearing guide strip 23 is integrated with the zipper 2 such that it is separated from the zipper 2 by interfacial peeling at the binding interface. Therefore, a resistant feel is reduced when the bag raw material on the unsealing side against the zipper 2 is torn to unseal the bag 1, and also, the tearing guide strip 23 works so as to guide the direction of tearing with fixed orientation such that the bag raw material is linearly torn along the longitudinal direction of the zipper 2. Therefore, the bag 1 is easily unsealed and the unsealing mouth 14 formed after the bag 1 is unsealed is formed in a well shape-reproducible manner and the bag 1 obtained after unsealed is not resultantly inconvenient in use.

Moreover, the tearing guide strip 23 is separated by interfacial peeling at the binding interface and therefore, no scum is generated on the peeled surface.

Also, in this embodiment, the following modifications of the embodiment are possible without impairing such effects.

Figure 5:
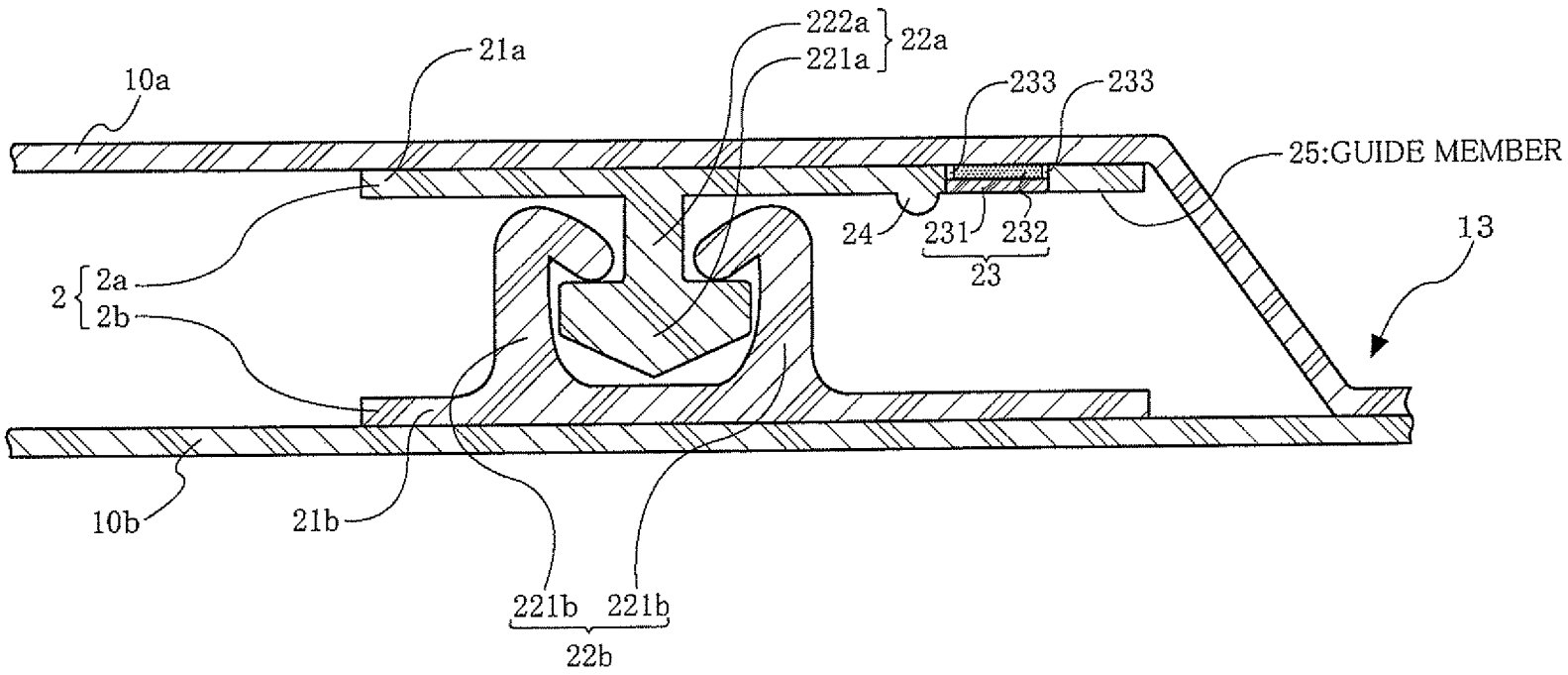
FIG. 5 is a sectional view showing a part corresponding to the section A-A of FIG. 1 in the condition of a zipper-equipped bag after a top seal is provided to a modification of a zipper-equipped bag of a first embodiment according to the present invention.

For example, the tearing guide strip 23 may be provided with a guide member 25 on the end part opposite to the side bound with the base part 21*a* of the male member 2*a* along the longitudinal direction of the end part as shown in FIG. 5.

At this time, the tearing guide strip 23 is integrated with the guide member 25 in the same binding condition as in the case binding to the base part 21*a* of the male member 2*a*, specifically, in the condition that the peeling strength is preferably 15 N/15 mm or less so as to enable interfacial peeling at the binding interface. Also, in the case where the tearing guide strip 23 is provided with the heat seal layer 232, it is so devised that the same gap 233 is formed between the heat seal layer 232 and the guide member 25. Also, the guide member 25 may be formed and integrated with the male member 2*a* simultaneously when the male member 2*a* is molded in such a manner as to carry out co-extrusion together with the tearing guide strip 23 by using the same resin material that is used for the male member 2*a*.

The resin material used for the guide member 25 may be different from that for the male member 2*a*. No particular limitation is imposed on the type of resin material used for the guide member 25 insofar as the guide member 25 can be bound with the tearing guide strip 23 in such a manner as not to hinder the tearing guide strip 23 from tearing the base film 10*a* in almost parallel to the zipper 2.

The provision of the guide member 25 as mentioned above makes it possible to efficiently avoid the phenomenon that when the tearing guide strip 23 is pulled to tear the base film 10*a*, the base film 10*a* is torn in a direction toward the top seal 13 side. Particularly, in the case where, as shown in FIG. 5, the tearing guide strip 23 is provided with the heat seal layer 232 and the gap 233 is formed on the both ends in the width direction of the heat seal layer 232, the tearing direction of the base film 10*a* can be guided more easily to the direction along the part where the base film 10*a* is bound with the tearing guide strip 23 such that the base film 10*a* is torn along the gap 233.

Here, in the example shown in FIG. 5, it is so devised that when the guide member 25 is disposed together with the tearing guide strip 23 on the base part 21*a* of the male member 2*a*, the length of the base part 21*b* of the male member 2*b* in the width direction is extended to the top seal 13 side such that the edge part of the base part 21*b* on the top seal 13 side is overlapped on the tearing guide strip 23 and the guide member 25. This is to avoid the occurrence of the phenomenon that the tearing guide strip 23 (or the base material 231 of the tearing guide strip 23) is eventually brought into contact with the base film 10*b* disposed on the opposite side. In this case, it is only required for the extended part to be formed such that it is overlapped on at least the tearing guide strip 23.

Such a structure makes it possible more exactly to tear the base film 10*a* of the bag 1 with ease by the tearing guide strip 23. This reason is as follows.

Specifically, generally the zipper 2 (male member 2*a* and female member 2*b*) and the bag 1 (base films 10*a* and 10*b*) are formed using the chemically same materials to bind the male member 2*a* and female member 2*b* of the zipper 2 firmly with the base films 10*a* and 10*b* of the bag 1 respectively by heat sealing. For example, linear low-density polyethylene (or linear low-density polyethylene polymerized using a metallocene catalyst) may be selected as the base films 10*a* and 10*b* (or heat seal layers (not shown) laminated on the base films 10*a* and 10*b*), low-density polyethylene may be selected as the male member 2*a* and female member 2*b* of the zipper 2 and polypropylene may be selected as the base material 231 of the tearing guide strip 23.

If the base material 231 of the tearing guide strip 23 is in contact with the base film 10*b* on the opposite side in the case of selecting resin materials in this combination, the base material 231 of the tearing guide strip 23 is firmly bound with the base film 10*a* (or heat seal layers (not shown) laminated on the base films 10*a* and 10*b*) on the opposite side in the vicinity of the side seal 11 of the bag 1. This makes difficult to tear the base film 10*a* by the tearing guide strip 23. In a typical case, this results in that the bag 1 cannot be unsealed. However, such a disorder can be efficiently avoided by preventing the base material 231 of the tearing guide strip 23 from being brought into contact with the base film 10*b* disposed on the opposite side.

Figure 6:
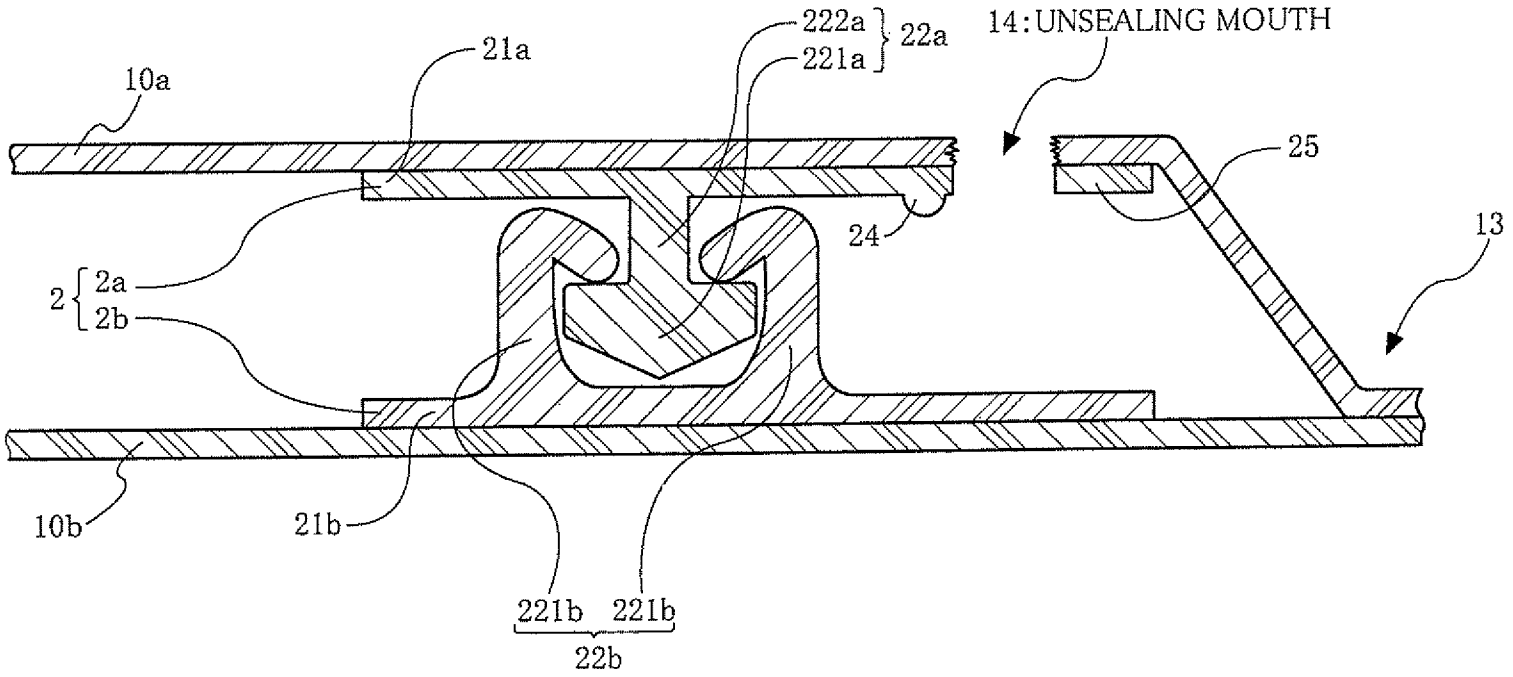
FIG. 6 is a sectional view showing a part corresponding to the section A-A of FIG. 1 after another modification of a zipper-equipped bag of a first embodiment according to the present invention is unsealed.

FIG. 5 is a sectional view showing the outline of the part corresponding to the section A-A in FIG. 1 in the state after the top seal 13 is provided in the same manner as in the case of FIG. 2 in such an example. FIG. 6 shows the state of the bag 1 unsealed by tearing the part bound with the tearing guide strip 23 of the base film 10*a*.

Also, in the above embodiment, the tearing guide strip 23 is disposed on the male member 2*a* side. However, the tearing guide strip 23 may be disposed on the female member 2*b* side. The tearing guide strip 23 may be disposed on both the male member 2*a* and the female member 2*b*, so that the bag 1 can be unsealed from either the surface side (base film 10*a* side) or the backside (base film 10*b* side). Moreover, the positional relationship between the male member 2*a* and the female member 2*b* may be reversed to that of the example shown in FIG. 2. In this case, the tearing guide strip 23 is disposed on the female member 2*b* side.

Also, in the above embodiment, the male member 2*a* and female member 2*b* of the zipper 2 are bound with the base film 10*a* and the base film 10*b* respectively by sealing to thereby fit the zipper 2 to the bag 1. The fitting means of the zipper 2 is not limited to the above case and for example, the fitting means as shown in FIG. 7 may be adopted.

Specifically, the male member 2*a* is bound with the base film 10*a* by heat sealing and the edge of the surface of the base part 21*b* of the extended female member 2*b* on the side provided with the female projection 22*b* may be fitted by heat sealing to the base film 10*a* at a corresponding position closer to the upper edge side of the bag 1 than the position of the male member 2*a*.

Such a fitting means enables the content to be filled in the bag 1 from the between the female member 2*b* and the base film 10*b*. Therefore, when the content is filled in the bag 1, it is unnecessary to release the interlocking of the zipper 2 and it is also possible to avoid the adhesion of the content to the interlocking part of the zipper 2. Such a fitting means is particularly preferable in a standing bag as shown in FIG. 1 which is limited in the port for filling the content.

Figure 7:
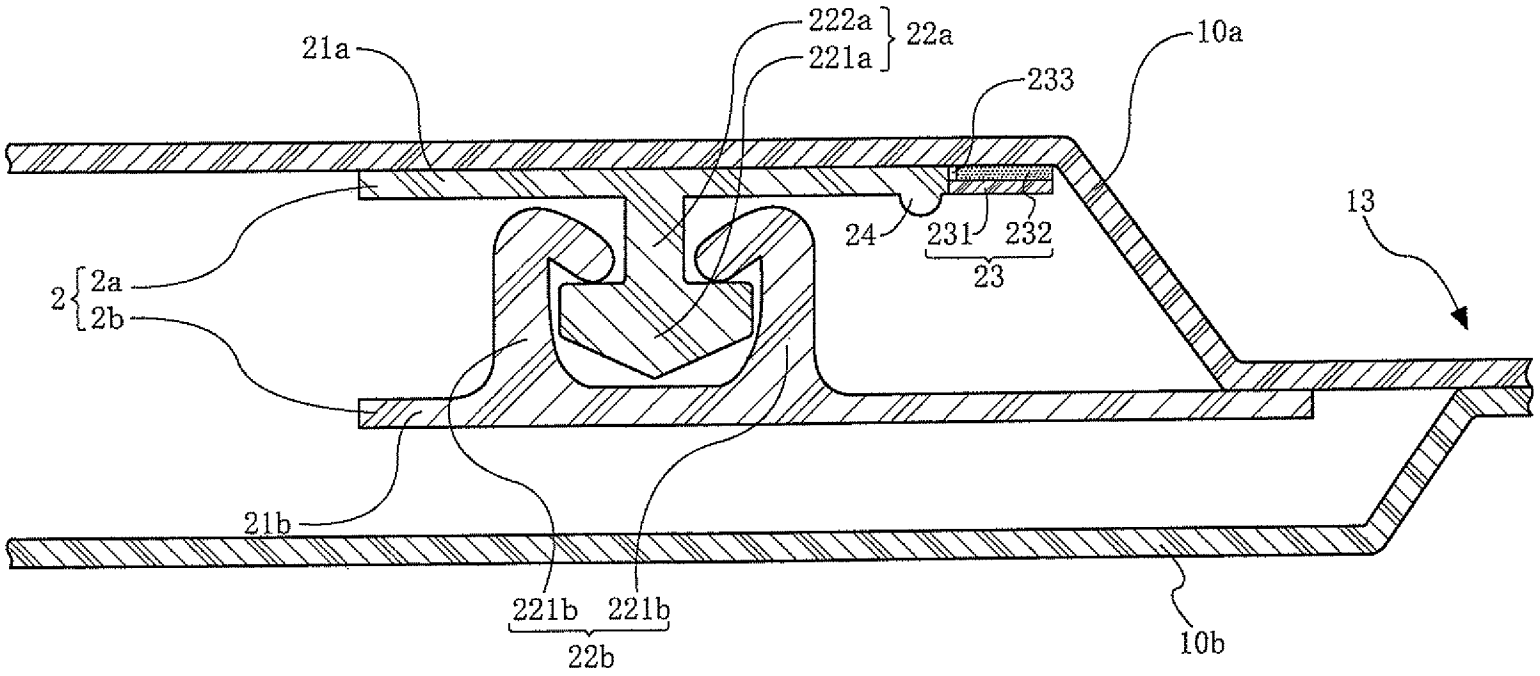
FIG. 7 is a sectional view of a part corresponding to the section A-A of FIG. 1 showing another example of a fitting means of a zipper according to the present invention.

Here, FIG. 7 is a sectional view showing the outline of the part corresponding to the section A-A of FIG. 1 in the state of the bag provided with the top seal 13 in the same manner as in the case of FIG. 2. In this example, the top seal 13 is provided after the content is filled from between the female member 2*b* and the base film 10*b*. Also, similarly to the case of the above embodiment, the positional relationship between the male member 2*a* and the female member 2*b* may be reversed to that of the example shown in FIG. 7. Moreover, like the example shown in FIG. 5, the guide member 25 may be integrated with the tearing guide strip 23 such that the gap 233 is formed between the guide member 25 itself and the heat seal layer 232 of the tearing guide strip 23. This makes it easy to unseal the bag 1 more linearly.

Figure 8:
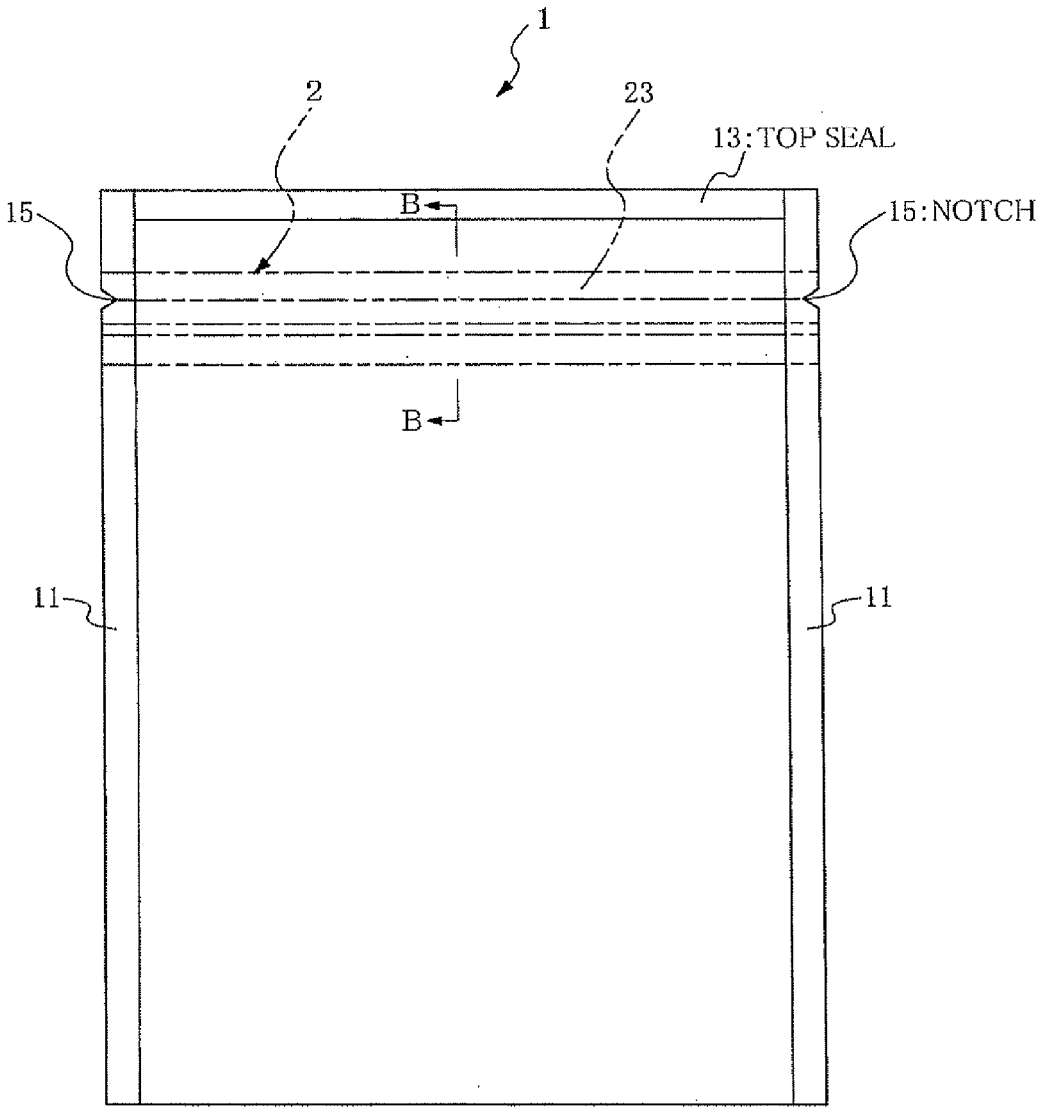
FIG. 8 is a plan view showing the outline of other modification of a zipper-equipped bag of a first embodiment according to the present invention.

Also, the shape of the zipper-equipped bag according to the present invention is not limited to those like standing bags, but may be desired shapes like flat bags and the like as shown in FIG. 8. The bag 1 shown in FIG. 8 is provided with the top seal 13 on its upper edge and the side seal 11 along its side edge. After the content is filled from an unsealed part at the lower edge side of the bag 1, the lower edge of the bag 1 is sealed.

Figure 9:
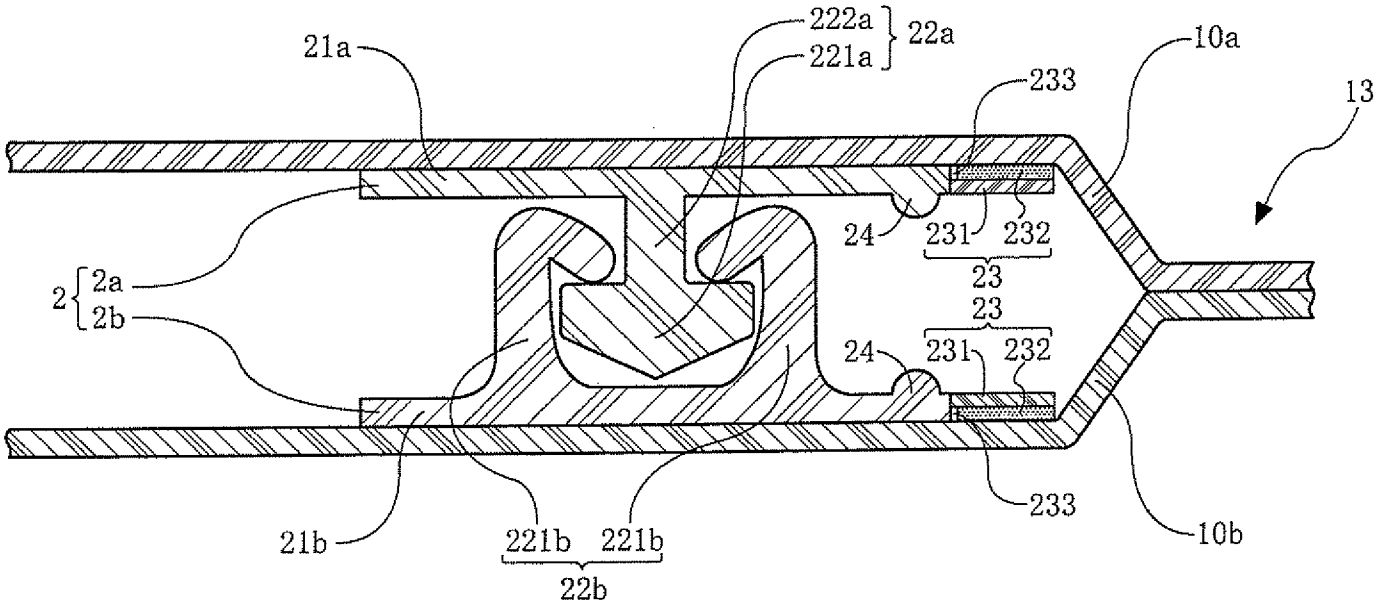
FIG. 9 is a sectional view along the line B-B of FIG. 8.

FIG. 9 is a sectional view along the line B-B of FIG. 8 wherein the tearing guide strip 23 is disposed on each of the male member 2*a* and the female member 2*b*. However, the tearing guide strip 23 may be disposed on one of the male member 2*a* and the female member 2*b* also in this example. Also, the relative positional relationship between the male member 2*a* and the female member 2*b* may be reversed to that of the example shown in FIG. 9.

Moreover, as to each of two tearing guide strips 23 shown in FIG. 9, like the example shown in FIG. 5, the guide member 25 may be integrated with the tearing guide strip 23 such that the gap 233 is formed between the guide member 25 itself and the heat seal layer 232 of the tearing guide strip 23. This makes it easy to unseal the bag 1 more linearly.

Figure 10:
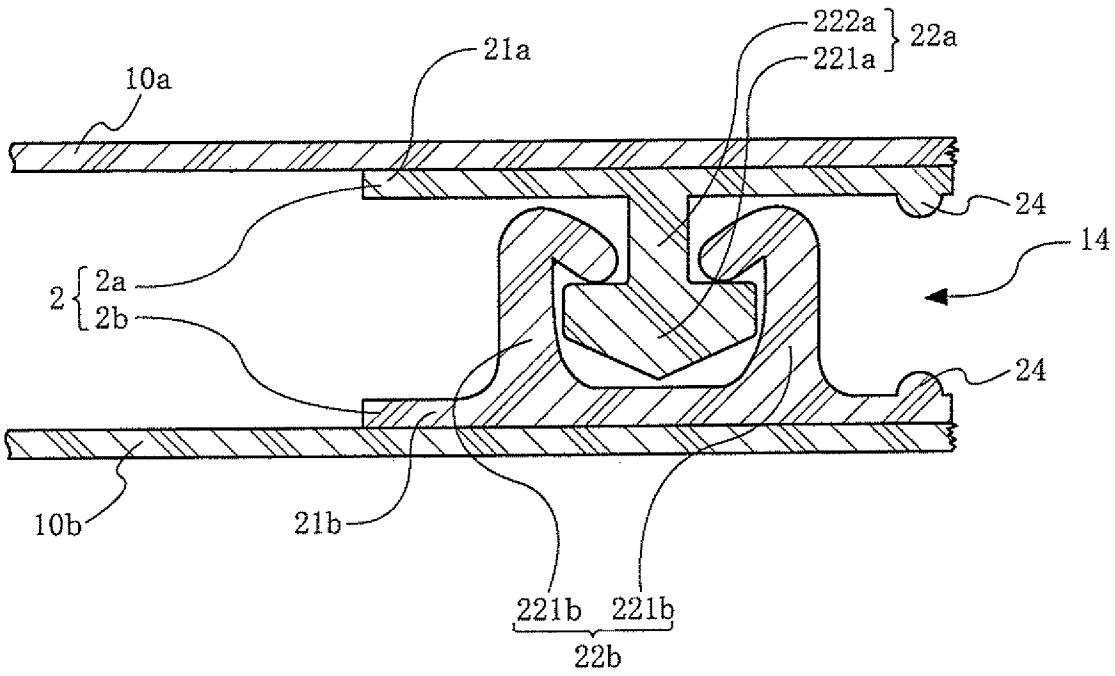
FIG. 10 is a sectional view showing a part corresponding to the section B-B of FIG. 1 after other modification of a zipper-equipped bag of a first embodiment according to the present invention is unsealed.

Also, the unsealing means of the bag 1 is not limited to that of the above embodiment. For example, as shown in FIG. 8, paired right and left notches 12 are disposed on the upper side of the side edge of the bag 1 and the line connecting these paired notches 12 is made to accord to the peeling part of the tearing guide strip 23 so that the tearing of the base films 10*a* and 10*b* of the bag 1 is initiated by making use of the notch 12 and these base films 10*a* and 10*b* can be torn linearly along the longitudinal direction of the zipper 2 (see FIG. 10).

Even in the case of adopting such an unsealing means, the tearing guide strip 23 may be provided on one of the male member and the female member. Also, the notch 12 may be disposed on only one of the right and left side of the side edge of the bag 1 if it is situated on the same line as the peeling part of the tearing guide strip 23.

[Second Embodiment]

Next, a zipper-equipped bag of a second embodiment according to the present invention will be explained.

Figure 11:
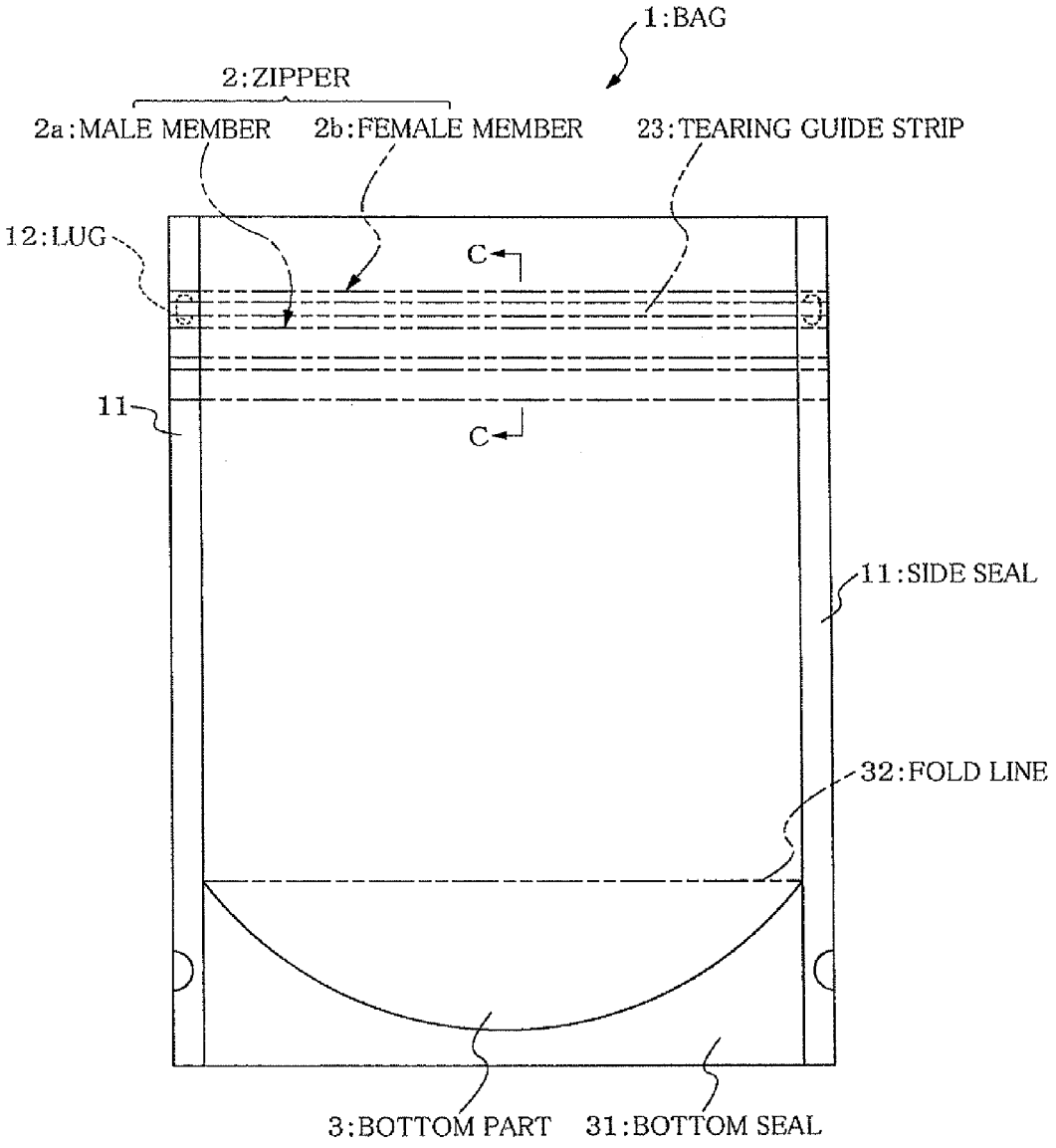
FIG. 11 is a plan view showing the outline of a zipper-equipped bag of a second embodiment according to the present invention.

FIG. 11 is a front view showing the outline of the zipper-equipped bag of an embodiment according to the present invention. A bag 1 shown in FIG. 11 is produced by making a bag using base films 10*a* and 10*b* used as a bag base material heat-sealed with a zipper 2 and is a so-called standing bag which is produced by providing a side seal 11 along the side edge in the state the bottom part 3 provided with a bottom seal 31 is folded along a fold line 32.

Also, in the example illustrated, the upper edge of the bag 1 is unsealed part. After the content is filled, a top seal 13 is provided.

Figure 12:
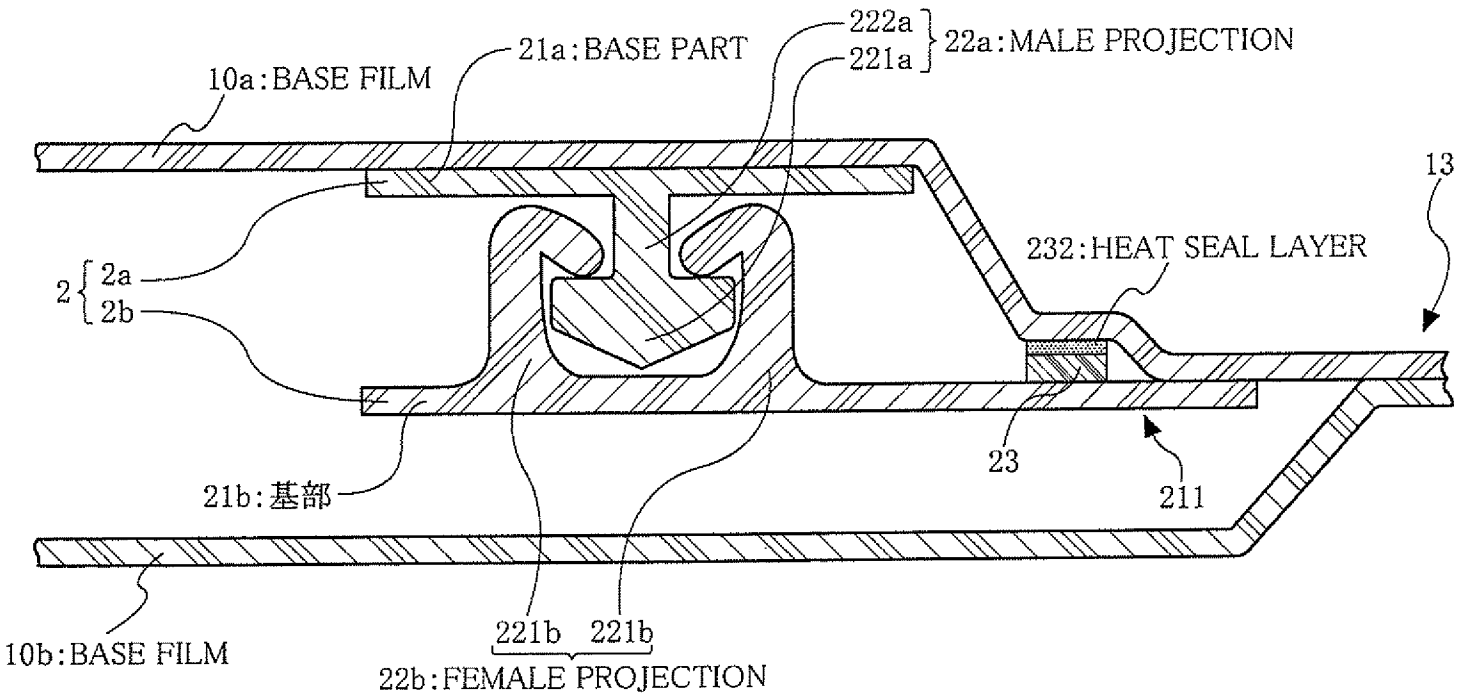
FIG. 12 is a sectional view showing a part corresponding to the section C-C of FIG. 11 in the condition of a zipper-equipped bag after a top seal is provided to a zipper-equipped bag of a second embodiment according to the present invention.

Here, FIG. 12 is a sectional view showing the outline of a part corresponding to the section C-C of FIG. 11 in the state after the top seal 13 is provided. After the content is filled in the bag 1 from between a female member 2*b* and the base film 10*b*, the top seal 13 is provided.

The zipper 2 in this embodiment is constituted of paired male member 2*a* and female member 2*b* as shown in FIG. 12.

The male member 2*a* is provided with a base part 21*a* formed continuously like a tape. A male projection 22*a* constituted of a head part 221*a* and a connecting part 222*a* connecting the head part 221*a* with the base part 21*a* is provided on one surface of the base part 21*a* and these parts are integrated. Similarly, the female member 2*b* is provided with a base part 21*b* formed continuously like a tape. A female projection 22*b* constituted of a pair of hook parts 221*b* and 221*b* is provided on one surface of the base part 21*b* and these parts are integrated.

In the zipper 2 constituted like this manner, the head part 221*a* of the male projection 22*a* is fitted in a space formed between the hook parts 221*b* and 221*b* of the female projection 22*b*, whereby the male member 2*a* and the female member 2*b* are interlocked with each other. Thereby the takeout port of the bag 1 can be sealed (resealing) after the bag is unsealed by the zipper 2. When the interlocking of the zipper 2 (interlocking between the male projection 22*a* and the female projection 22*b*) is released, the takeout port of the bag 1 can be unsealed.

The specific shapes of the male projection 22*a* and female projection 22*b* are not limited to those shown in the figure as long as these projections have fitting shapes which are paired and interlocked with each other.

Also, in the zipper 2 of this embodiment in the condition that the male member 2*a* and the female member 2*b* are interlocked with each other and fitted to the bag 1, the base part 21*b* of the female member 2*b* in the width direction of the base part 21*b* is extended so as to be projected to the side where the top seal 13 is to be provided, such that the length of the base part 21 in the width direction is larger than that of the base part 21*a* of the male member 2*a* as shown in FIG. 12. Then, on the surface of the extended part 211 on the side on which the female projection 22*b* is formed, a tearing guide strip 23 peelable from the female member 2*b* is integrated along the longitudinal direction of the female member 2*b*.

Here, in the example illustrated, the tearing guide strip 23 is disposed apart from the edge of the extended part 211 side of the base part 21*b* of the female member 2*b* to secure its heat seal surface with the base film 10*a* along the edge of the extended part 211 side of the base part 21*b* of the female member 2*b*.

When the tearing guide strip 23 is formed on the base part 21*b* of the female member 2*b*, the peeling strength between the tearing guide strip 23 and the base part 21*b* is designed to be preferably 15 N/15 mm or less. When the peeling strength exceeds this value, there is a fear that the force required to separate the tearing guide strip 23 from the base part 21*b* by peeling is increased and it is therefore difficult to obtain a good unsealing feel. Moreover, such a disorder arises that the extended part 211 is also torn.

Also, although the peeling of the tearing guide strip 23 may be any of interfacial peeling and cohesive peeling, the former is preferable. The interfacial peeling can prevent peeling scum from being produced on the peeled surface after the tearing guide strip 23 is separated from the base part 21*b*.

Here, the peeling strength between the tearing guide strip 23 and the base part 21*b* means the largest load found when the both put in a bound state are cut into a test piece having a width of 15 mm and the test piece is subjected to a tensile tester carried out at a measuring atmospheric temperature of 23° C. at a tensile rate of 200 mm/min to peel the both from each other along the direction perpendicular to the direction of the width of the test piece.

Also, in the example illustrate, the tearing guide strip 23 is provided with a heat seal layer 232 made of a resin which can be bound with the base film 10*a* by heat sealing on the surface opposite to the binding interface of the base part 21*b* with the female member 2*b*, namely, on the surface facing the base film 10*a* and the tearing guide strip 23 is designed to be bound by sufficient binding strength with the part where the base film 10*a* is torn when the bag 1 is unsealed as will be explained later.

At this time, the binding strength between the base film 10*a* and the tearing guide strip 23 is preferably made to be larger than the peeling strength between the tearing guide strip 23 and the female member 2*b*. It is thereby possible to efficiently avoid the peeling of the tearing guide strip 23 from the base film 10*a* and to allow the peeling of the tearing guide strip 23 from the base part 21*b* to prevail.

The zipper 2 in this embodiment which is provided with the tearing guide strip 23 like this may be fitted to the bag 1 by binding the surface of the base part 21*a* of the male member 2*a* which surface is opposite to the surface on which the male projection 22*a* is formed and the surface of the base part 21*b* of the female member 2*b* on which surface the female projection 22*b* along the edge of the extended part 211 with the same surface of the base film 10*a* by heat sealing. At this time, the tearing guide strip 23 is also bound with the base film 10*a* by heat sealing.

If the zipper 2 is fitted to the bag 1 in this manner, the content can be filled from the space between the female member 2*b* and the base film 10*b*. Therefore, when the content is filled in the bag 1, it is unnecessary to release the interlocking of the zipper 2 and it is also possible to avoid the adhesion of the content to the interlocking part of the zipper 2. Such a fitting means is particularly effective for a standing bag limited in the port for filling the content as shown in FIG. 11.

Also, if the tearing guide strip 23 is bound with the base part 21*b* in a freely peelable manner and can be bound with the base film 10*a* by a higher binding strength than the peeling strength from the female member 2*b* by heat sealing, the heat seal layer 232 may be eliminated as desired.

In this embodiment, the male member 2*a* and the female member 2*b* may be formed, for example, by extrusion molding of a thermoplastic resin. As the thermoplastic resin, for example, a polyolefin type resin such as polypropylene, low-density polyethylene (LDPE) and linear low-density polyethylene (LLDPE) and an ethylene/methacrylic acid copolymer may be used. The zipper 2 may have a multilayer structure using plural resins in consideration of the interlocking ability between the male member 2*a* and the female member 2*b*, the sealing strength and heat sealing characteristics of the zipper 2 with the base films 10*a* and 10*b*.

Also, the same thermoplastic resin made into a film form may be used for the base films 10*a* and 10*b* in consideration of the sealing strength with the zipper 2 (male member 2*a* and female member 2*b*) and heat sealing characteristics. The base films 10*a* and 10*b* may have a multilayer structure to allow these films to exhibit various functions as the bag. In this case, for example, the inside layer to be the inside surface of the bag 1 is formed of the same thermoplastic resin as above as the heat seal layer for the zipper 2. Also, biaxially oriented nylon, biaxially oriented polyethylene terephthalate or biaxially oriented polypropylene may be laminated as the outside surface of the bag 1, and a barrier layer made of an aluminum foil or an ethylene/vinyl alcohol copolymer film may be laminated as an intermediate layer.

The tearing guide strip 23 and the heat seal layer 232 may be integrated with the female member 2*b* simultaneously when the female member 2*b* is extrusion-molded, for example, by extrusion-supplying the material forming these parts so as to carry out co-extrusion when the female member 2*b* is extrusion-molded.

As the resin forming the tearing guide strip 23, a resin incompatible with the resin used for the female member 2*b* may be selected. For example, in the case of using polyethylene for the female member 2*b*, polypropylene may be used as the resin forming the tearing guide strip 23. On the other hand, when polypropylene is used for the female member 2*b*, a polyester resin such as polyethylene terephthalate and polybutylene terephthalate may be used as the resin forming the tearing guide strip 23. A modifier may be added properly to these resins, to thereby adjust the peeling strength between the both.

Also, as the resin forming the heat seal layer 232, one which has sufficient binding strength with the base film 10*a* and the tearing guide strip 23 and is resistant to peeling from these materials when the bag 1 is unsealed is properly selected. For example, when polyethylene is used for the base film 10*a* (or the heat seal layer for zipper 2) and polypropylene is used for the tearing guide strip 23, metallocene type linear low-density polyethylene may be used. Also, when polypropylene is used for the base film 10*a* (or the heat seal layer for the zipper 2) and polybutylene terephthalate is used for the tearing guide strip 23, a modified polyolefin type resin such as maleic acid anhydride modified polypropylene or a resin containing the modified polyolefin type resin may be used.

Also, the tearing guide strip 23 preferably has a higher rigidity than the base part 21*a* of the female member 2*b* to allow itself to be well separated from the female member 2*b* without being destroyed by material destruction when it is separated from the female member 2*b* and to give no hindrance to tearing of the base film 10*a*. More specifically, the tensile elastic modulus of the tearing guide strip 23 is preferably 1.3 to 4 times that of the base part 21*a* of the male member 2*a*. At this time, the tensile elastic modulus of the tearing guide strip 23 is particularly preferably in a range from 300 to 2500 MPa.

When the tensile elastic modulus of the tearing guide strip 23 exceeds the above range, the tearing guide strip 23 is broken when the bag is unsealed, leading to such a disorder that the bag is unsealed with difficulty.

On the other hand, when the tensile elastic modulus of the tearing guide strip 23 is less than the above range, the tearing guide strip 23 has only insufficient rigidity, causing a hindrance to the peeling from the male member 2*a* or the tearing of the base film 10*a*.

Moreover, such a disorder is caused that the tearing guide strip 23 is broken and the bag 1 cannot be unsealed resultantly.

Figure 13:
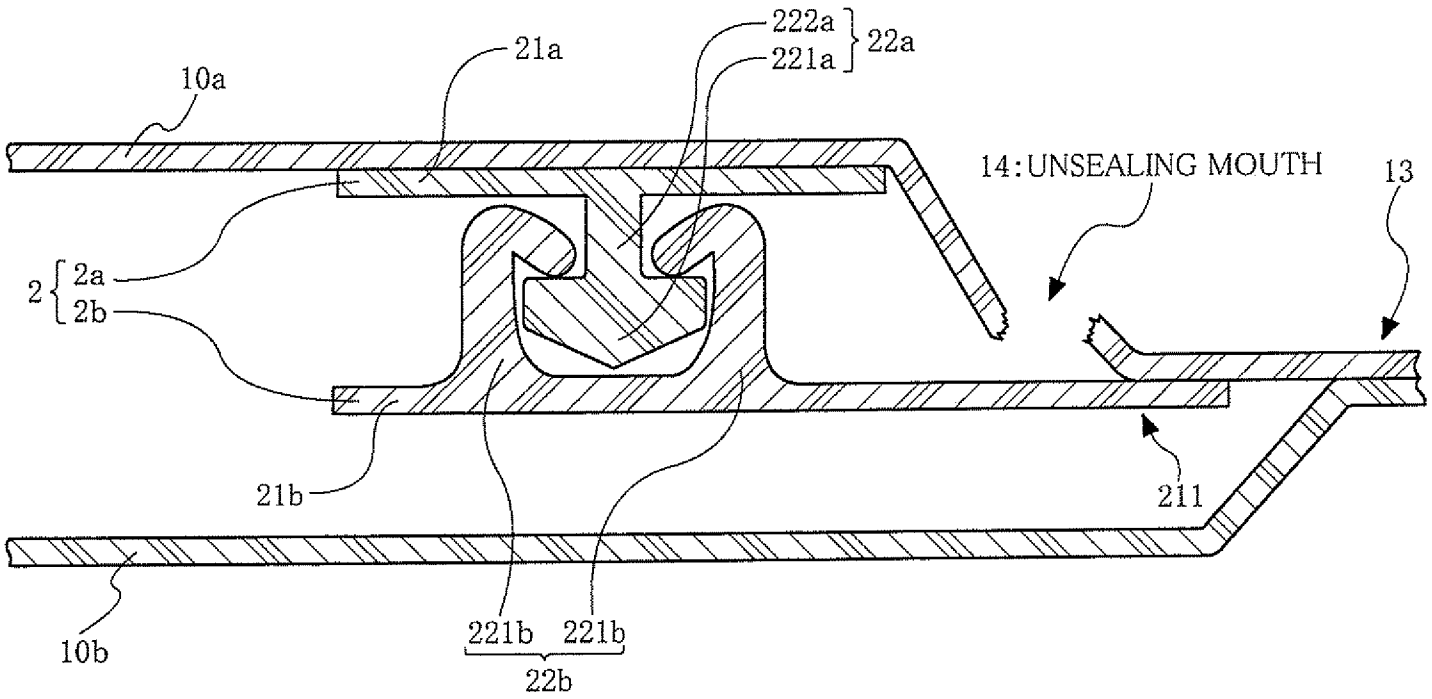
FIG. 13 is a sectional view showing a part corresponding to the section C-C of FIG. 11 after a zipper-equipped bag of a second embodiment according to the present invention is unsealed.

The bag 1 provided with the zipper 2 is unsealed by pulling the tearing guide strip 23 to tear the part of base film 10*a* bound with the tearing guide strip 23. An unsealing mouth 14 which is to be a mouth for taking in or out the content is formed at the place left after the above part is torn as shown in FIG. 13 and therefore, the content can be taken in or out by releasing the zipper 2. Also, if the zipper 2 is interlocked, the bag 1 can be resealed and after the bag 1 is unsealed, the takeout port can be unsealed or sealed by the zipper 2.

As mentioned above, the tearing guide strip 23 is integrated with the extended part 211 of the base part 21*b* of the female member 2*b* along the longitudinal direction of the extended part 211 such that it is separated from the female member 2*b* by peeling. Therefore, the bag 1 is decreased in resistant feel in unsealing and the tearing direction of the base film 10*a* can be guided linearly with a fixed orientation along the longitudinal direction of the zipper 2 without being disturbed by the male member 2*a*.

Therefore, the bag 1 is easily unsealed and the unsealing mouth 14 formed after unsealed is formed in a well shape-reproducible manner and the bag 1 obtained after unsealed is not resultantly inconvenient in use.

Figure 14:
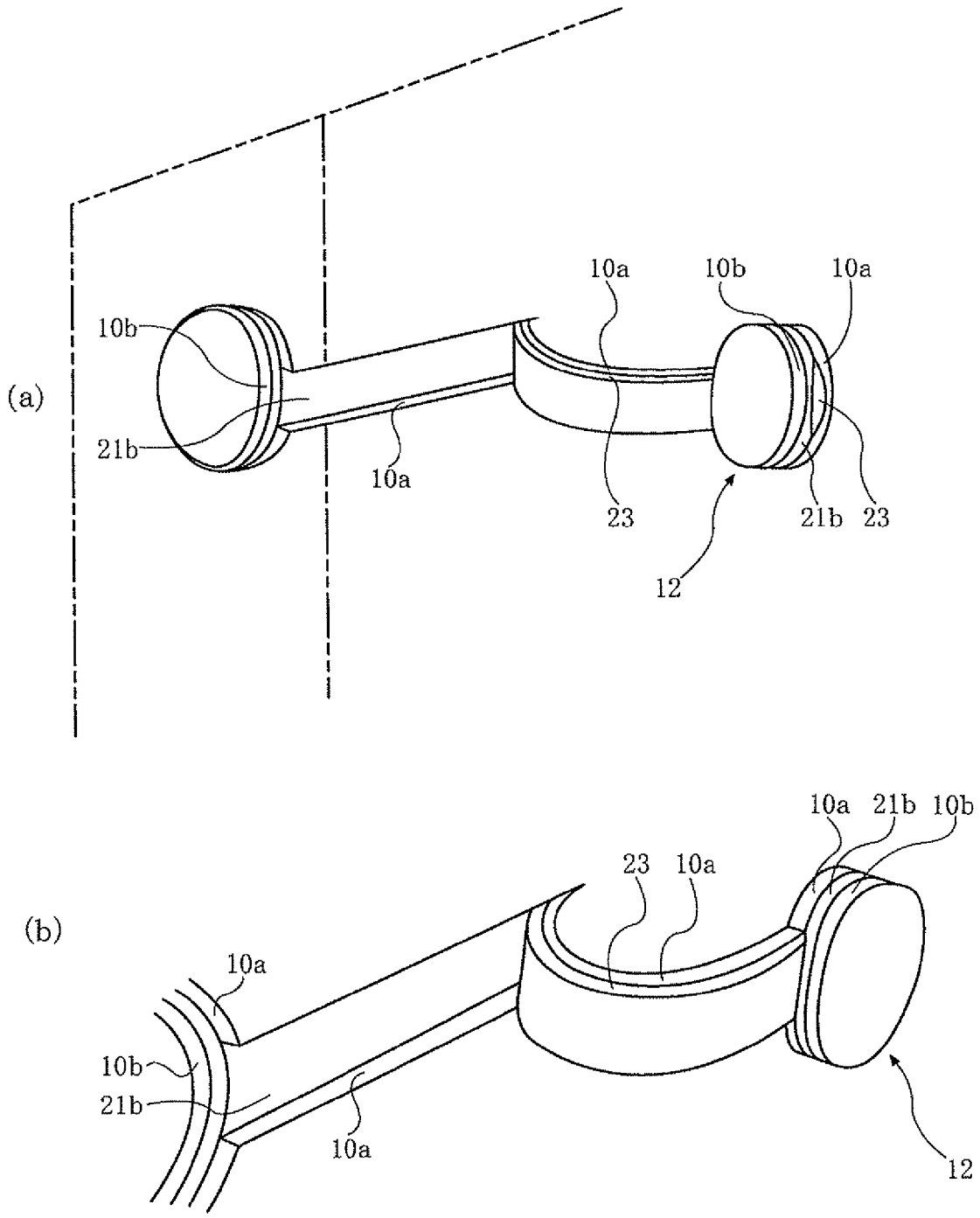
FIG. 14 is an explanatory view showing one example of an unsealing means of a zipper-equipped bag.

Here, an example of a specific means of tearing the base film 10*a* by the tearing guide strip 23 to unseal the bag 1 is shown in FIG. 14.

In the example illustrated, half-cut treatment has been carried out in such a manner as to form a lug 12 penetrating through a part where the side seal 11 on which the tearing guide strip 23 is positioned is formed. It is so devised that at this time, the base film 10*b* forming a part of the lug 12 is cut off from the other part of the base film 10*b* and the base film 10*a* forming a part of the lug 12 is cut off from a part other than the part torn when the base film 10*a* is unsealed, to form the lug 12 in the state where the tearing guide strip 23 is sandwiched between the separated base films 10*a* and 10*b*.

When the lug 12 is constituted in this manner, the lug 12 is, as is illustrated, picked up to pull the tearing guide strip 23, whereby the base film 10*a* is torn by the tearing guide strip 23 to form the unsealing mouth 14.

In the example illustrated, a part of the base part 21*b* of the female member 2*b* is cut off and put into the state sandwiched between the base films 10*a* and 10*b*. The cut part of the base part 21*b* has no influence on the unsealing function of the lug 12.

According to this embodiment, as mentioned above, the tearing guide strip 23 is integrated with one of the male member 2*a* and the female member 2*b* such that it is separated from the zipper 2 by peeling. Therefore, a resistant feel is reduced when the bag raw material on the unsealing side against the zipper 2 is torn to unseal the bag 1. Also, since the part where the tearing guide 23 is disposed is made to project toward the side closer to the unsealing side of the bag 1 than the other of the male member 2*a* and the female member 2*b*, the tearing guide strip 23 works so as to guide the direction of tearing with fixed orientation such that the bag raw material is linearly torn along the longitudinal direction of the zipper 2 without being hindered by the other of the male member 2*a* and female member 2*b*.

Therefore, the bag 1 is easily unsealed and the unsealing mouth 14 formed after unsealed is formed in a well shape-reproducible manner and the bag 1 obtained after unsealed is not resultantly inconvenient in use.

Also, in this embodiment, the following modifications of the embodiment are possible without impairing such effects.

For example, in the above embodiment, the tearing guide strip 23 is disposed on the female member 2*b* side. However, the tearing guide strip 23 may be disposed on the male member 2*a* side to thereby reverse the relative positional relationship between the female member 2*b* and the male member 2*a* to that of the example illustrated.

Also, in the above embodiment, the male member 2*a* and female member 2*b* of the zipper 2 are bound with the base film 10*a* by heat sealing to thereby fit the zipper 2 to the bag 1. The fitting means of the zipper 2 is not limited to the above case.

Figure 15:
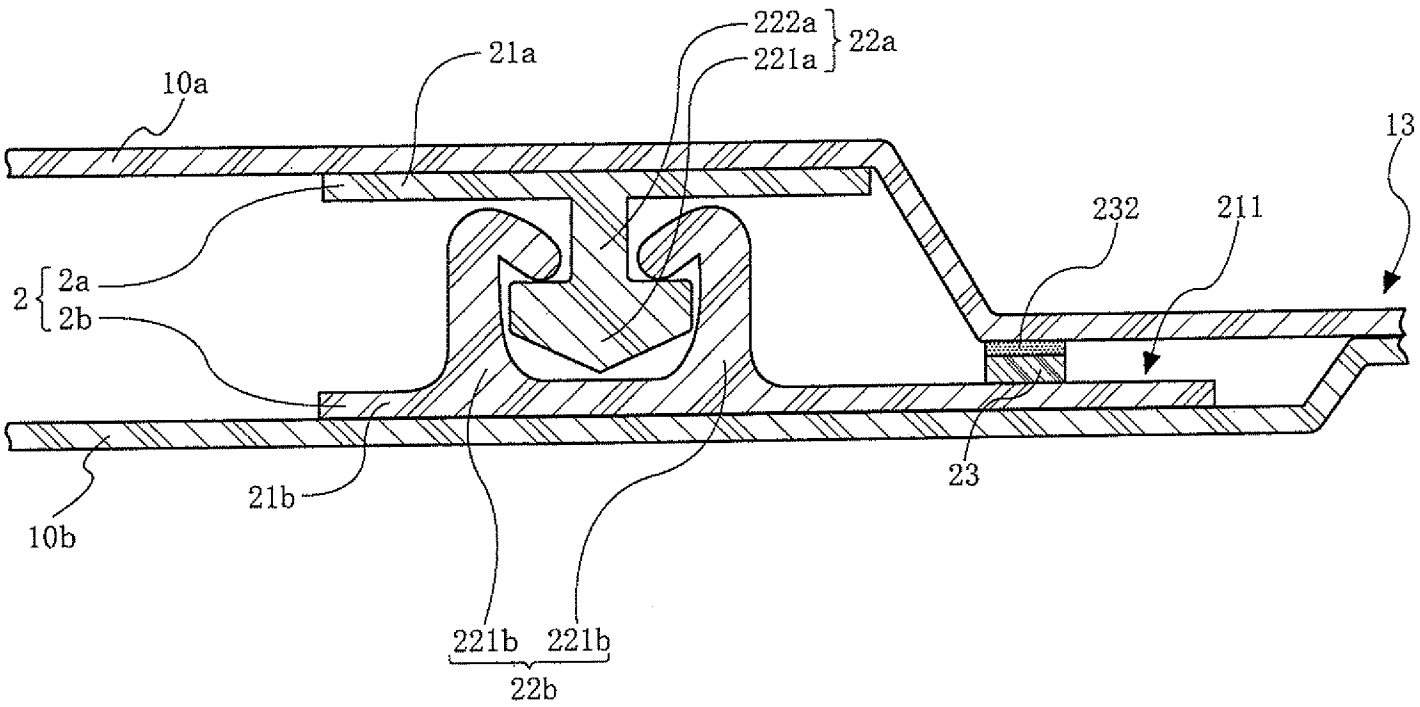
FIG. 15 is a sectional view showing a part corresponding to the section C-C of FIG. 11 showing another example of a fitting means of a zipper.

For example, as shown in FIG. 15, the male member 2*a* may be bound with the base film 10*a* and the female member 2*b* may be bound with the base film 10*b* by sealing to thereby fit the zipper 2 to the bag 1.

Here, FIG. 15 is a sectional view showing the outline of the part corresponding to the section C-C of FIG. 11 in the state of the bag provided with the top seal 13 in the same manner as in the case of FIG. 12. In this example, the top seal 13 is provided in such a manner as to form a predetermined space between the top seal 13 itself and the zipper 2 fitted to the upper side of the bag 1. Also, similarly to the case of the above embodiment, the relative relationship between the male member 2*a* and the female member 2*b* may be reversed to the case of the example shown in FIG. 15.

Figure 16:
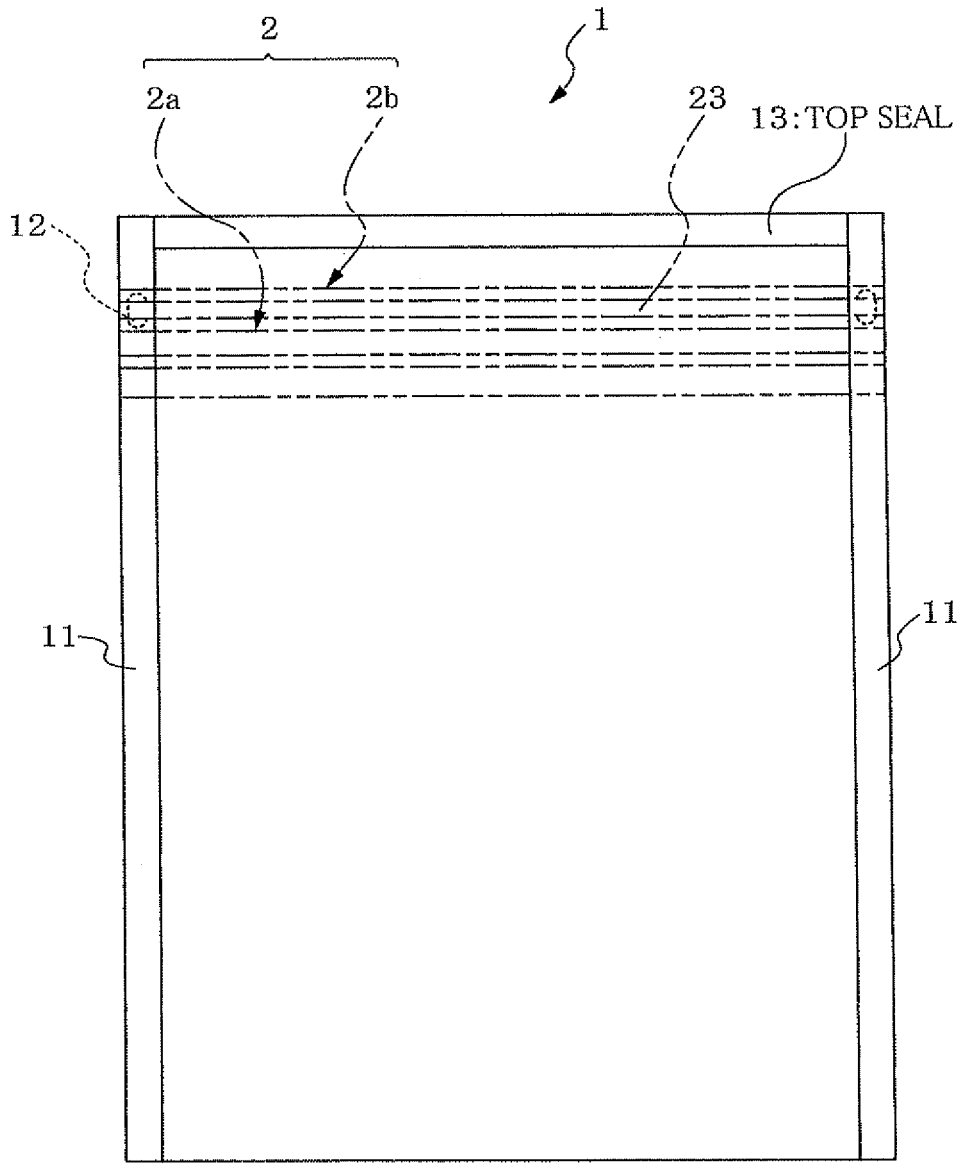
FIG. 16 is a plan view showing the outline of a modification of a second embodiment of a bag according to the present invention.

Also, the shape of the zipper-equipped bag according to the present invention is not limited to those like standing bags, but may be desired shapes like flat bags and the like as shown in FIG. 16. The bag 1 shown in FIG. 16 is provided with the top seal 13 on its upper edge and the side seal 11 along its side edge. After the content is filled from an unsealed part at the lower edge side of the bag 1, the lower edge of the bag 1 is sealed.

Then, the present invention will be explained in more detail by way of specific examples.

EXAMPLE 1

A low-density polyethylene (melting point: 110° C.) having a density of 926 kg/m$^3$ and a MFR of 1.5 g/10 min was melt-extruded to extrusion-mold a male member. At the same time, using random polypropylene (melting point 134° C.) having a density of 900 kg/m$^3$ and a MFR of 7.0 g/10 min was used as the base material and metallocene type low-density polyethylene having a density of 900 kg/m$^3$ and a MFR of 4.0 g/10 min was used as heat seal layer, these raw materials were extrusion-supplied to one end in the width direction of the male member to integrate a tearing guide strip with the male member simultaneously when the male member is molded, thereby obtaining the male member provided with the tearing guide strip. At this time, the heat seal layer of the tearing guide strip was formed 0.6 mm apart from the base part of the male member in such a manner as to form a gap.

A female member provided with a tearing guide strip was molded in the same manner, and a zipper tape provided with paired male member and female member as shown in FIG. 9 was obtained.

As to both the male member and the female member, the peeling strength of the binding interface between the tearing guide strip and the base part of the male member or female member was 4 N/15 mm and the tensile elastic modulus of the tearing guide strip was 813 MPa. Also, each base part of the male member and the female member had a tensile elastic modulus of 237 MPa.

The above zipper tape and a base film obtained by dry-laminating a biaxially oriented nylon film (15 μm) and a linear low-density polyethylene film (50 μm) were used to make a bag by a three-way bag machine such that the side of the above zipper tape on which side the tearing guide strip was disposed was located on the unsealing side and the linear low-density polyethylene film side of the above base film was to be the inner surface. Also, a notch was formed on the edge of the bag in such a manner that it is disposed on the same line as the binding part between the zipper tape and the tearing guide strip, to obtain a zipper-equipped bag as shown in FIGS. 8 and 9.

The binding strength between the base film and the tearing guide strip was 30 N/15 mm.

EXAMPLE 2

A zipper-equipped bag as shown in FIGS. 1 and 2 was obtained in the same manner as in Example 1 except that only the male member was provided with the tearing guide strip and the means shown in FIG. 4 was used as the unsealing means.

COMPARATIVE EXAMPLE 1

A zipper-equipped bag was obtained in the same manner as in Example 1 except that the zipper tape was obtained according to the Example 1 of Patent Document 1.

The notch to be formed on the side edge of the bag was positioned on the center in the width direction of the easy cuttable resin layer.

(Evaluation)

Each zipper-equipped bag obtained in Example 1 and Comparative Example 1 was unsealed by tearing the base films on the both front and back sides from the notch formed on the side edge of the bag and carry out a functional test concerning the tearing resistance at this time. Also, the exposed surface of the zipper tape after the bag was unsealed was observed to evaluate whether cutting scum was present or not.

With regard to the zipper-equipped bag obtained in Example 2, it was subjected to tests to evaluate the tearing resistance and the presence or absence of cutting scum when the lug was picked up to pull the tearing guide strip, thereby tearing the base film with which the tearing guide strip was bound to unseal the bag, in the same manner as above.

The results of evaluation are as follows.

TABLE 1

| | Tearing resistance | Cutting scum | Overall evaluation |
|---|---|---|---|
| Example 1 | ○ | ○ | ○ |
| Example 2 | ○ | ○ | ○ |
| Comparative Example 1 | ○ | X | X |

Evaluation Standard (1) Tearing Resistance

○: The bag was easily unsealed without any resistant feel and was unsealed with a good feel.

X: A resistant feel was felt and the bag was unsealed with a poor feel.

(2) Cutting Scum

○: No cutting scum was observed.

X: Cutting scum was observed.

Although the invention has been described in its preferred embodiment, the present invention is not limited to the above first and second embodiments and it should be understood that various changes and modifications may be made within the scope of present invention insofar as the tearing guide strip 23 is integrated with at least one of the base parts 21*a* and 21*b* of the male member 2*a* and female member 2*b* and can be separated from the base parts 21*a* or 21*b* of the male member 2*a* or female member 2*b*.

Then, the bag 1 equipped with the zipper 2 like this can be easily unsealed by pulling the tearing guide strip 23 to tear the bag raw material. Also, the unsealing ability of the bag can be improved because the force required to unseal the bag can be reduced to the utmost by adjusting the binding state of the tearing guide strip 23 with the base parts 21*a* and 21*b* of the male member 2*a* and female member 2*b*.

Also, in the above first embodiment and second embodiment, the zipper 2 is bound with the base films 10*a* and 10*b* as the bag raw material by heat sealing when the zipper 2 is fitted to the bag 1. However, an adhesive may be applied to the binding interface between the zipper 2 and the bag raw material of the tearing guide strip 23 to bind the zipper 2 with the bag raw material. If it is so devised that the zipper 2 is bound with the bag raw material by using an adhesive, even paper having no heat sealing ability may be used as the bag raw material.

In this case, it is not particularly necessary to provide the heat seal layer 232 in the tearing guide strip 23.

Also, in all the above examples, the zipper 2 is not limited to one having a paired male projection 22*a* and female projection 22*b* as illustrated but may be one having plural paired male projections 22*a* and female projections 22*b*. In this case, plural paired male projections 22*a* and female projections 22*b* are formed on the same base parts 21*a* and 21*b*. Moreover, a zipper which is not provided with the tearing guide strip 23 is prepared separately from the zipper 2 provided with the tearing guide strip 23 and these zippers are fitted to the bag 1 such that the zipper 2 provided with the tearing guide strip 23 is located on the unsealing side.

Industrial Applicability

As explained above, the present invention may be widely utilized for a zipper-equipped bag which is freely sealed and unsealed since it is provided with an interlocking type zipper at the mouth for taking in and out the content.

The invention claimed is:

1. A zipper comprising:

a male member having a base part and a male projection and female member having a base part and a female projection, wherein the male projection and the female projection are interlockable with each other, and wherein the zipper is optionally fitted to a bag and enables said bag to be resealed and unsealed, wherein the base part of the male member or the female member has an extended part such that when the male member and the female member are in an interlocked position, the base part of one of said male or female members extends laterally in a width direction beyond the end of the base part of the other of the male or female members, a tearing guide strip is provided along the longitudinal direction of the base part on the surface of the extended part, the extended part and the tearing guide strip are formed as one integrated molded article, and the tearing guide strip is peelable from the surface of the extended part at a binding interface, and wherein the extended part and the tearing guide strip are directly in contact with each other and the tearing guide strip is peelable from the surface of the extended part by interfacial peeling.

2. The zipper of claim 1, wherein the tearing guide strip is provided with a heat seal layer or an adhesive on a surface opposite the binding interface.

3. The zipper of claim 1, wherein a peeling strength necessary to peel the tearing guide strip from the extended part is up to 15 N/15 mm.

4. The zipper of claim 1, wherein the tearing guide strip is suitable for being bound with a material forming the bag by higher binding strength than the maximum peeling strength necessary to peel the tearing guide strip from the extended part.

5. The zipper according to claim 1, wherein the resin forming the tearing guide strip is polypropylene and the resin forming the extended part is polyethylene.

6. The zipper according to claim 1 wherein the base part of the male member or the female member having the extended part, laterally has a length B in the width direction and the other of the base part of the male member or the female member has a width A in the width direction wherein B>A.

7. The zipper according to claim 1 wherein the extended part and said tearing guide strip have been integrated by co-extrusion molding.

8. The zipper of claim 1, wherein the tearing guide strip has a higher rigidity than the extended part.

9. The zipper of claim 1, wherein the tearing guide strip has a tensile elastic modulus 1.3 to 4 times that of the extended part.

10. A zipper comprising:

male member having a base part and a male projection and female member having a base part and a female projection, wherein the male projection and the female projection are interlockable with each other, the zipper is optionally fitted to a bag and enables said bag to be resealed and unsealed, wherein the base part of the male member or the female member has an extended part, such that when the male member and the female member are in an interlocked position, the base part of one of said male or female members extends laterally in a width direction beyond the end of the base part of the other of the male or female members, a tearing guide strip is provided along the longitudinal direction of the base part on the surface of the extended part, wherein the extended part and the tearing guide strip are formed as one integrated molded article, and the tearing guide strip is peelable from the surface of the extended part at a binding interface, and wherein a resin material forming the tearing guide strip and a resin material of the extended part are incompatible with each other.

11. The zipper of claim 10, wherein the tearing guide strip is provided with a heat seal layer or an adhesive on a surface opposite the binding interface.

12. The zipper of claim 10, wherein a peeling strength necessary to peel the tearing guide strip from the extended part is up to 15 N/15 mm.

13. The zipper of claim 10, wherein the tearing guide strip is suitable for being bound with a material forming the bag by higher binding strength than the peeling strength necessary to peel the tearing guide strip from the extended part.

14. The zipper of claim 10 wherein the incompatible resins forming the tearing guide strip and the extended part allow for the tearing guide strip to be peeled from the surface of the extended part by interfacial peeling.

15. The zipper according to claim 10, wherein the resin forming the tearing guide strip is polypropylene and the resin forming the extended part is polyethylene.

16. The zipper according to claim 10 wherein the base part of the male member or the female member having the extended part, laterally has a length B in the width direction and the other of the base part of the male member or the female member has a width A in the width direction wherein B>A.

17. The zipper according to claim 10 wherein the extended part and said tearing guide strip have been integrated by co-extrusion molding.

18. A zipper equipped bag comprising:

a zipper and a bag, wherein the zipper comprises a male member having a base part and a male projection and female member having a base part and a female projection, wherein the male projection and the female projection are interlockable with each other, and wherein the zipper is fitted to the bag and enables said bag to be resealed and unsealed, wherein the base part of the male member or the female member has an extended part such that when the male member and the female member are in an interlocked position, the base part of one of said male or female members extends laterally in a width direction beyond the end of the base part of the other of the male or female members, a tearing guide strip is provided along the longitudinal direction of the base part on the surface of the extended part, the extended part and the tearing guide strip are formed as one integrated molded article, and the tearing guide strip is peelable from the surface of the extended part at a binding interface, wherein the extended part and the tearing guide strip are directly in contact with each other and the tearing guide strip is peelable from the surface of the extended part by interfacial peeling, and wherein the bag comprises at least one base film.

19. The zipper equipped bag of claim 18 wherein the bag comprises at least two base films and the tearing guide strip and both base parts are bound to a same surface of one of the base films.

20. The zipper equipped bag according to claim 18 wherein the base part of the male member or the female member having the extended part, laterally has a length B in the width direction and the other of the base part of the male member or the female member has a width A in the width direction wherein B>A.

21. The zipper equipped bag of claim 18, wherein a surface of the base part of one of the male member or the female member on a side along an end edge of the extended part on which the male projection or the female projection is formed, is bound to the same surface of one base film to which the base part of the other of said male member or female member is bound.

22. The zipper equipped bag of claim 18, wherein an upper edge of the bag has an unsealed part.

23. The zipper equipped bag of claim 18, wherein a top seal is provided along an upper edge of the bag.

24. A zipper equipped bag comprising:

a zipper and a bag, wherein the zipper comprises a male member having a base part and a male projection, and a female member having a base part and a female projection wherein the male projection and the female projection are interlockable with each other, wherein the zipper is fitted to the bag and enables said bag to be resealed and unsealed, wherein the base part of one of the male member and the female member has an extended part such that when the male member and the female member are in an interlocked position, the base part of one of said male or female members extends laterally in a width direction beyond the end of the base part of the other of the male or female members, a tearing guide strip is provided along the longitudinal direction of the base part on the surface of the extended part, the extended part and the tearing guide strip are formed as one integrated molded article, and the tearing guide strip is peelable from the surface of the extended part at a binding interface, wherein a resin material forming the tearing guide strip and a resin material forming the extended part are incompatible with each other, wherein the bag comprises at least one base film.

25. The zipper equipped bag of claim 24 wherein the bag comprises at least two base films and the tearing guide strip and both base parts are bound to a same surface of one of the base films.

26. The zipper equipped bag according to claim 24 wherein the base part of the male member or the female member having the extended part, laterally has a length B in the width direction and the other of the base part of the male member or the female member has a width A in the width direction wherein B>A.

27. The zipper equipped bag of claim 24, wherein a surface of the base part of one of the male member or the female member on a side along an end edge of the extended part on which the male projection or the female projection is formed, is bound to the same surface of one base film to which the base part of the other of said male member or female member is bound.

28. The zipper equipped bag of claim 24, wherein an upper edge of the bag has an unsealed part.

29. The zipper equipped bag of claim 24, wherein a top seal is provided along an upper edge of the bag.

30. The zipper equipped bag of claim 24 wherein the incompatible resins forming the tearing guide strip and the extended part allow for the tearing guide strip to be peeled from the surface of the extended part by interfacial peeling.

* * * * *